US009273495B2

(12) United States Patent
Tien

(10) Patent No.: US 9,273,495 B2
(45) Date of Patent: Mar. 1, 2016

(54) PANIC EXIT DOOR LOCK WITH AN INDICATION OF A LOCKING STATE

(71) Applicant: I-TEK METAL MFG. CO., LTD., Tainan (TW)

(72) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 222 days.

(21) Appl. No.: 14/202,010

(22) Filed: Mar. 10, 2014

(65) Prior Publication Data

US 2015/0252592 A1 Sep. 10, 2015

(51) Int. Cl.
*E05B 65/10* (2006.01)
*E05B 41/00* (2006.01)

(52) U.S. Cl.
CPC ..... *E05B 65/10* (2013.01); *E05B 41/00* (2013.01); *E05B 65/1053* (2013.01); *Y10T 70/5159* (2015.04)

(58) Field of Classification Search
CPC ..... E05B 39/00; E05B 41/00; E05B 63/16; E05B 63/18; E05B 63/185; E05B 63/22; E05B 65/10; E05B 65/1006; E05B 65/102; E05B 65/1046; E05B 65/1053; E05B 65/1086; E05B 65/1093
USPC ..... 70/92, 107–111, 439, 441
See application file for complete search history.

(56) References Cited

U.S. PATENT DOCUMENTS 3,877,262 A * 4/1975 Williams ..... E05B 65/1073 292/92
5,823,582 A * 10/1998 Frolov ..... E05B 65/1053 292/21
5,947,534 A * 9/1999 Zarzycki, Jr. ..... E05B 65/1053 292/170
7,044,510 B2 * 5/2006 Lin ..... E05B 65/1073 292/93
7,634,927 B1 12/2009 Tien ..... 70/92
7,722,096 B2 * 5/2010 Arlinghaus ..... E05B 15/102 292/92
8,011,702 B2 9/2011 Tein et al. ..... 292/336.3
8,182,003 B2 * 5/2012 Dye ..... E05B 47/0012 292/216
8,201,857 B2 * 6/2012 Tien ..... E05B 63/0056 292/92
9,140,032 B2 * 9/2015 Lin ..... E05B 17/0066
9,169,669 B2 * 10/2015 Clary ..... E05B 41/00
2001/0006293 A1 * 7/2001 Rupp ..... E05B 65/1053 292/336.3
2012/0242092 A1 * 9/2012 Frolov ..... E05B 47/026 292/92
2015/0167354 A1 * 6/2015 Tien ..... E05B 65/10 292/92
2015/0225982 A1 * 8/2015 Bronner ..... E05B 41/00 70/432

* cited by examiner

*Primary Examiner* — Christopher Boswell
(74) *Attorney, Agent, or Firm* — Alan D. Kamrath; Kamrath IP Lawfirm, P.A.

(57) ABSTRACT

A panic exit door lock includes an outer operational device mounted to an outer side of a door, an inner operational device mounted to an inner door of the door, a lock mounted in the door, and a locking mechanism mounted between the inner and outer operational devices and the lock. The locking mechanism includes an outer cylinder mounted to the outer operational device and an inner cylinder mounted to the inner operational device. An indicator member is operably connected to the inner cylinder and a setting member. The setting member is connected to a transmission block. When a key is used to set a locking function of the inner or outer cylinder, the transmission block and the indicator member pivot jointly. A user can see whether the locking function is set by observing the position of the indicator member via a window of an inner cylinder seat.

4 Claims, 20 Drawing Sheets

PANIC EXIT DOOR LOCK WITH AN INDICATION OF A LOCKING STATE

BACKGROUND OF THE INVENTION

The present invention relates to a panic exit door lock with an indication of a locking state and, more particularly, to a panic exit door lock including a locking state indicator providing a visual indication from an inner side of a door.

Panic exit door locks (or referred to as "exit devices for doors") are widely used on panic exit doors and passageway doors in apartment houses and buildings to keep the frequently used doors in a state allowing easy passage. Such panic exit door locks generally include a press bar mounted to a side of the door and having a larger area to allow easy and rapid unlatching through simple pressing of the press bar, which is particularly useful in case of emergency, such as fire. Furthermore, the panic exit door locks can include a locking function in which a user at the inner side of the door can easily unlock while a user at the outer side of the door must use a key. However, the user at the inner side of the door can not confirm whether the panic exit door lock is in the locking state by pressing the press bar.

Thus, a need exists for a panic exit door lock including a locking state indicator providing a visual indication from the inner side of the door.

BRIEF SUMMARY OF THE INVENTION

The present invention solves this need and other problems in the field of indication of the locking state of panic exit door locks by providing a panic exit door lock including a cover adapted to be mounted to an outer side of a door. The cover defines a space. A handle is rotatably mounted to an outer side of the cover. A driving member is mounted in the space of the cover. The driving member is operably connected to the handle. The driving member and the handle pivot jointly. A case is adapted to be mounted in a mounting hole of the door. An unlocking member is pivotably mounted in the case. The unlocking member and the driving member pivot jointly. The unlocking member pivots when the handle rotates. A latch is slideably received in the case and is operably connected to the unlocking member. The latch is movable between a latching position outside of the case and an unlatching position inside of case when the unlatching member pivots.

The panic exit door lock further includes a locking member slideably mounted in the case. The locking member is movable between a locking position preventing pivotal movement of the unlocking member and an unlocking position allowing pivotal movement of the unlocking member. A rocker is pivotably mounted in the case and operably connected to the locking member. The locking member moves between the locking position and the unlocking position when the rocker pivots. A base is adapted to be mounted to an inner side of the door opposite to the outer side of the door. A driving rod is pivotably mounted in the base. The driving rod is operably connected to the latch. The latch moves from the locking position to the unlocking position when the driving rod pivots. An operative member is slideably mounted to the base and is operably connected to the driving rod. The driving rod pivots when the operative member is moved.

The panic exit door lock further includes an outer cylinder including an outer cylinder body mounted to the cover and an outer lock core rotatably received in the outer cylinder body. An actuating block is fixed to the outer lock core. The actuating block and the outer lock core pivot jointly. The actuating block is operably connected to the rocker. An inner cylinder seat is fixed to the base and includes a peripheral wall defining a first compartment. A shield is formed on the peripheral wall and defines a second compartment. The shield further includes a window in communication with the second compartment. An inner cylinder is received in the first compartment. The inner cylinder includes an inner cylinder body and an inner lock core rotatably received in the inner cylinder body.

The panic exit door lock further includes an indicator member including a pivotal portion pivotably connected to the inner cylinder seat. The indicator member further includes an arm extending from the pivotal portion. An indicator is provided on the arm and has a first portion indicating the unlocking member is in the unlocking position and a second portion indicating the unlocking member is in the locking position. One of the first and second portions is selectively aligned with the window. A tongue is fixed to the inner lock core. The tongue and the inner lock core pivot jointly. The tongue extends through the pivotal portion of the indicator member. The tongue and the indicator pivot jointly. A setting member is pivotably mounted in the case and is connected to the rocker. The setting member and the rocker move jointly. The setting member and the indicator member move jointly. The setting member and the rocker pivot jointly when the inner lock core pivots.

When the inner lock core is rotated in a direction, the indicator member is moved to a position in which the first portion or the second portion is aligned with the window of the inner cylinder seat. When the outer lock core is rotated in a direction, the actuating block pivots to drive the setting member to pivot via the rocker, causing one of the first and second portions of the indicator member to align with the window of the inner cylinder seat. When the first portion of the indicator member is aligned with the window of the inner cylinder seat, the locking member is in the locking position, and the unlocking member and the latch are not moved if the handle is rotated. When the second portion of the indicator member is aligned with the window of the inner cylinder seat, the unlocking member is in the unlocking position, and the unlocking member is moved to move the latch from the latching position to the unlatching position if the handle is rotated.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
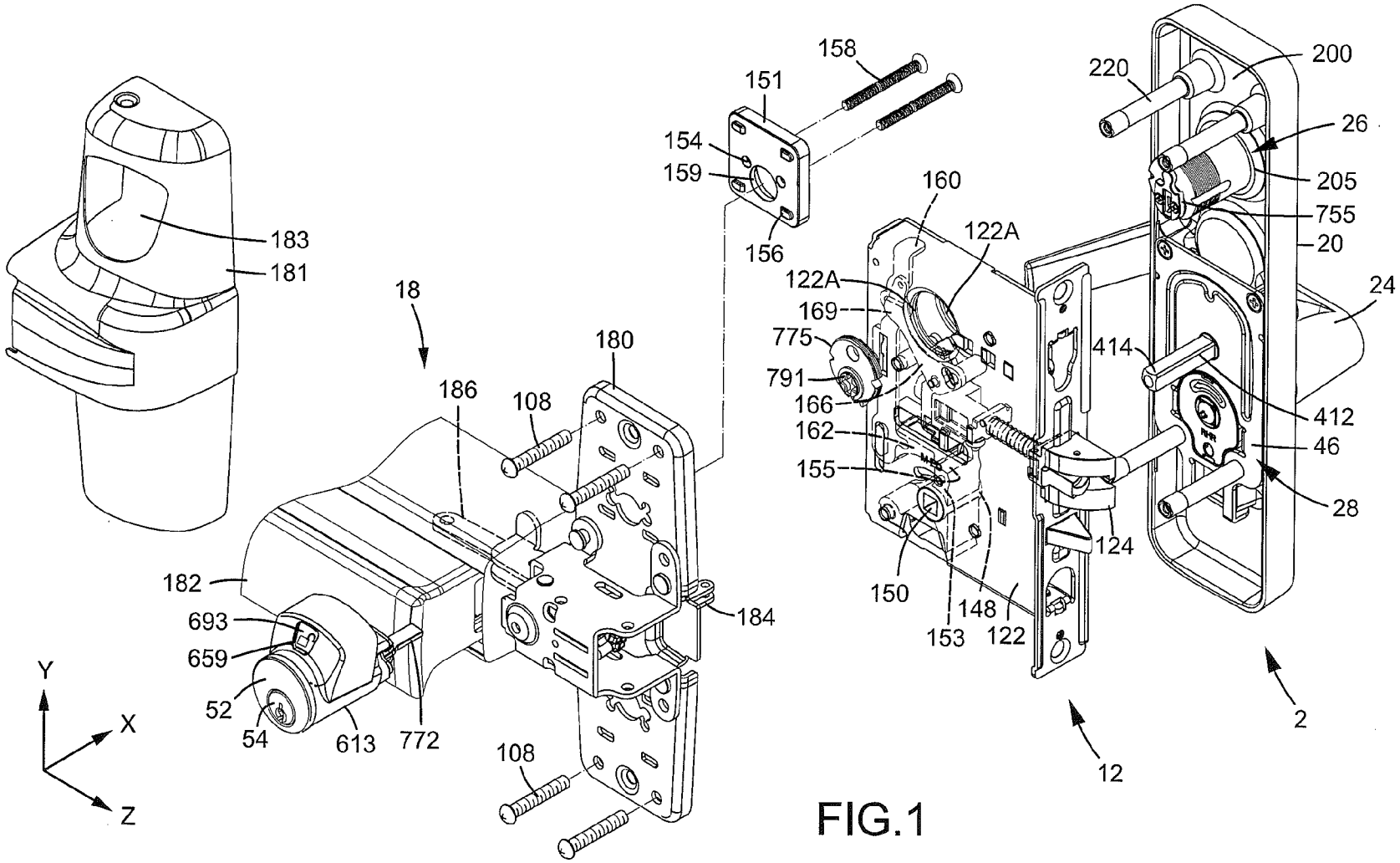
FIG. 1 is an exploded, perspective view of a panic exit door lock according to the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "front", "rear", "upper", "inner", "outer", "side", "end", "portion", "section", "axial", "lateral", "horizontal", "vertical", "annular", "inward", "spacing", "clockwise", "counterclockwise", "length", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A panic exit door lock according to the present invention is shown in the drawings and is adapted to be mounted to a side of a door 10. According to the form shown, door 10 includes an inner side 10A and an outer side 10B. It is noted that inner and outer sides 10A and 10B are exchanged when door 10 is installed as a differently handed door. According to the form shown in FIG. 3, door 10 is installed as a right-handed door. Furthermore, door 10 includes a mounting hole 105 in an edge extending between inner side 10A and outer side 10B. Door 10 further includes a plurality of first holes 102 extending from inner side 10A through outer side 10B. Door 10 further includes a second hole 104 in outer side 10B and a third hole 109 in inner side 10A. Each of first, second, and third holes 102, 104, and 109 is in communication with mounting hole 105.

In the form shown, the panic exit door lock includes a lock 12 in the form shown as a mortise lock. Lock 12 is mounted in mounting hole 105. The panic exit door lock further includes an inner operational device 18 mounted to inner side 10A of door 10, an outer operational device 2 mounted to outer side 10B of door 10, and a locking mechanism 3 mounted in inner and outer operational devices 18 and 2 (see FIGS. 2, 3, 10, and 11). Inner and outer operational devices 18 and 2 and lock 12 can be of any desired form as conventional including but not limited to of a commercially available type.

According to the form shown, lock 12 includes a case 122 mounted in mounting hole 105 of door 10 and having an opening 123 in a lower end thereof. Case 122 further includes a sliding groove 127 in a side thereof. Case 122 further includes two mounting holes 122A aligned with each other, located above sliding groove 127, and having inner threads. A retractor 120 is slideably received in case 122 and is slideably received in sliding groove 127. A spring 125 is mounted between retractor 120 and a latch 124, allowing latch 124 to move along a first axis X between a latching position outside of case 122 and an unlatching position inside of case 122 responsive to sliding movement of retractor 120.

According to the form shown, an unlocking member 148 is pivotably mounted in case 122 and is located below latch 124 along a second axis Y perpendicular to first axis X. Unlocking member 148 includes a push arm 153 formed on an outer periphery thereof and a follower arm 157 located below push arm 153 along second axis Y. A hole 150 is formed in a center of unlocking member 148. A groove 155 is formed in a distal end of push arm 153 and is spaced from hole 150.

According to the form shown, a push rod 144 is pivotably mounted in case 122 and is located adjacent to unlocking member 148. Push rod 144 is arcuate and includes an end 146 abutting retractor 120. The other end of push rod 144 is pivotably connected to case 122. Push arm 153 of unlocking member 148 abuts a side of push rod 144. In the form shown, push rod 144 can only be pushed by push arm 153 to pivot when unlocking member 148 rotates in the counterclockwise direction in FIG. 4. Namely, push rod 144 is not moved if unlocking member 148 rotates in the clockwise direction.

According to the form shown, a locking member 160 is slideably received in case 122 and includes a horizontal guide slot 164 in an upper portion thereof. Locking member 160 includes a stop 162 at a lower portion thereof. A transmission block 129 and a rocker 166 are pivotably mounted in case 122. Specifically, transmission block 129 is substantially a triangle when viewed from a side and includes first and second ends 129B and 129C and a pivotal portion 129A between first and second ends 129B and 129C. In the form shown, the pivotal portion 129A and first and second ends 129B and 129C are substantially located in three apexes of the triangle. Transmission block 129 further includes a toothed portion 129D located between the first and second ends 129B and 129C and opposite to pivotal portion 129A. Toothed portion 129D includes a plurality of teeth. Transmission block 129A overlaps with a portion of rocker 166 and is pivotably received in case 122. Pivotal portion 129A of transmission block 129 is pivotably connected to rocker 166. First end 129B of transmission block 129 is mounted to rocker 166. Thus, transmission block 129 and rocker 166 can pivot jointly.

Rocker 166 has an end 169 slideably received in guide slot 164 of locking member 160. Thus, when transmission block 129 pivots, rocker 166 pivots and, thus, moves locking member 160 to move stop 162 of locking member 160 between an unlocking position (FIGS. 4 and 5) aligned with groove 155 of push arm 153 of unlocking member 148 and a locking position (FIGS. 17 and 18) not aligned with groove 155 of push arm 153 to prevent movement of push arm 153. A pressing rod 168 is pivotably mounted in case 122 and abuts a lower portion of follower arm 157. Pressing rod 168 can be coupled through a lift arm to a handle, so that operation of the handle causes pivotable movement of unlocking member 148 through follower arm 157. However, pressing rod 168 can be omitted without adversely affecting operation of outer operational device 2.

According to the form shown, inner operational device 18 includes a base 180, a driving rod 184 pivotably mounted to base 180, and a linking rod 186 slideably received in base 180. An operative member 182 in the form shown as a press bar is pivotably mounted outside of base 180 and is operably connected to linking rod 186. An end of driving rod 184 extends through third hole 109 of door 10 and sliding groove 127 into case 122 of lock 12 and abuts a side of retractor 120. When operative member 182 is actuated, linking rod 186 is moved to draw driving rod 184, which, in turn, moves retractor 120. Thus, latch 124 is moved from the latching position to the unlatching position for unlatching purposes. A casing 181 is mounted around base 180 and includes an opening 183 in an upper portion thereof.

For safety consideration, operative member 182 of inner operational device 18 for a panic exit door has a large area to allow easy access and operation by a user. Furthermore, in urgent conditions, door 10 will be opened by operating operative member 182 whether lock 12 is in the locking state or unlocking state. Outer operational device 2 provides a locking function and allows opening door 10 from the outside.

According to the form shown, outer operational device 2 includes a cover 20 having a sidewall 202 extending in a vertical direction and an annular wall 204 extending perpendicularly along a periphery of sidewall 202, defining a space 200 between annular wall 204 and sidewall 202. Sidewall 202 includes a receiving portion 205 in an upper portion thereof. Receiving portion 205 extends into space 200 and forms a compartment 206 that has an opening 208 in communication with space 200. Sidewall 202 further includes a fixing hole 210 below opening 208. Sidewall 202 further includes an engaging hole 214 below fixing hole 210. A protrusion 215 extends from an inner face of sidewall 202 below engaging hole 214 and includes a groove 216. Two pegs 218 are formed on the inner face of sidewall 202 and are located above opening 208. Annular wall 204 includes two supports 217 on two inner, vertical faces thereof. Each support 217 has a height from sidewall 202 the same as that of protrusion 215.

Two mounting posts 220 are extended through two of first holes 102 of door 10 into screw holes in pegs 218. Furthermore, two additional mounting posts 220 extend through the other two first holes 102 into screw holes in protrusions 215. Cover 20 is mounted to outer side 10B of door 10 and covers second and third holes 104 and 109, with annular wall 204 abutting outer side 10B. Each mounting post 220 has an end abutting base 180. A fastener 108 extends through base 180 into a screw hole in the end of each mounting post 220.

According to the form shown, outer operational device 2 further includes a substantially cylindrical sleeve 22 mounted to an outer face of sidewall 202. Sleeve 22 includes a central pivot hole 222 aligned with engaging hole 214 of cover 20. Fasteners 224 extend through sidewall 202 into holes 226 in an end face of sleeve 22 to fix sleeve 22 on cover 20.

According to the form shown, outer operational device 2 further includes a handle 24 having a stem 240 located outside of cover 20 and adapted to be gripped by a user. Handle 24 further includes a shank 242 extending from an end of stem 240. Shank 242 includes an engaging portion 244 in the form shown having two chamfered faces 246 so that engaging portion 244 has non-circular cross sections. Shank 242 is pivotably received in pivot hole 222 of sleeve 22 about a pivot axis, and engaging portion 244 is located outside of pivot hole 222. A retainer ring 248 in the form shown as a C-clip is mounted around shank 242 to prevent axial movement of handle 24 along the pivot axis.

According to the form shown, outer operational device 2 further includes an actuating member 36 having a connecting hole 364 in an intermediate portion thereof. Two diametrically opposed rectangular grooves 366 are formed in an inner periphery of connecting hole 364. Actuating member 36 further includes first and second ends 360 and 362 on opposite sides of connecting hole 364. Shank 242 of handle 24 extends through connecting hole 364. A first axle 368 is formed on a side of first end 360 of actuating member 36 facing cover 20, and a second axle 368 is formed on a side of second end 362 of actuating member 36 facing cover 20.

According to the form shown, outer operational device 2 further includes a follower 38 in the form shown as a ring. Follower 38 includes a non-circular hole 382 corresponding to non-circular engaging portion 244 of handle 24 and extending along a central axis thereof. Follower 38 further includes two diametrically opposed teeth 380 extending in a direction parallel to and spaced from the central axis of follower 38. Engaging portion 244 of handle 24 is received in non-circular hole 382 of follower 38, with follower 38 located outside of actuating member 36 and with teeth 380 engaged in grooves 366. Thus, handle 24 and follower 38 rotate jointly due to non-circular hole 382 and non-circular engaging portion 244. Furthermore, since teeth 380 of follower 38 are engaged in grooves 366 of actuating member 36, rotation of handle 24 also causes rotation of actuating member 36.

According to the form shown, outer operational device 2 further includes a driving member 40 including a pivotal portion 410 in the form shown as a rod. Pivotal portion 410 includes diametrically opposed first and second wings 402 and 404. Each of first and second wings 402 and 404 includes a peg 408 facing cover 20. An end of pivotal portion 410 is pivotably received in fixing hole 210 of cover 20, such that driving member 40 is rotatable about a central axis of fixing hole 210.

Driving member 40 further includes a driving rod 412 extending from a central portion thereof between first and second wings 402 and 404. Driving rod 412 includes non-circular cross sections. Driving rod 412 further includes a front end 414 extending through third hole 109 into hole 150 of unlocking member 148, so that rotation of driving rod 412 also causes rotation of unlocking member 148.

According to the form shown, outer operational device 2 further includes first and second links 34, with each of first and second links 34 having upper and lower ends 340 and 342. Upper end 340 of first link 34 is pivotably coupled with peg 408 of first wing 402 between first wing 402 and sidewall 202. Upper end 340 of second link 34 is pivotably coupled with peg 408 of second wing 402 between second wing 404 and sidewall 202. Lower end 342 of first link 34 is pivotably coupled with first axle 368 of actuating member 36 between first end 360 of actuating member 36 and sidewall 202. Lower end 342 of second link 34 is pivotably coupled with second axle 368 of actuating member 36 between second end 362 of actuating member 36 and sidewall 202.

According to the form shown, outer operational device 2 further includes an inner lid 46 having an opening 462 through which engaging portion 244 of handle 24 extends. A bend 466 is formed on an inner periphery of opening 462. Inner lid 46 further includes a through-hole 464 above opening 462. Inner lid 46 abuts protrusion 215 and supports 217, and fasteners 468 extend through inner lid 46 into screw holes in supports 217. Two of mounting posts 220 extend through inner lid 46 into screw holes in protrusion 215. Thus, inner lid 46 is fixed in space 200 of cover 20. The other end of pivotal portion 410 is pivotably received in through-hole 464 of inner lid 46 to support stable rotation of driving member 40.

According to the form shown, outer operational device 2 further includes a returning device 28 having a body 296 with a non-circular outer periphery. Body 296 includes a lobe 300 on a lower end thereof and having rectangular cross sections. Lobe 300 is received in groove 216 of cover 20 to prevent rotation of body 296. Body 296 further includes a compartment 298 in a side thereof. Compartment 298 forms an engaging groove 302 in lobe 300. A bottom wall defining compartment 298 includes a pivot hole 308. Two limiting blocks 304 are formed on the side of body 296 along a periphery of pivot hole 308. Each limiting block 304 includes an end 306. Furthermore, each limiting block 304 has a height to the side of body 296 smaller than or equal to a depth of compartment 298. A housing 282 slightly larger than body 296 is mounted to the side of body 296 to cover compartment 298. Housing 282 includes an axial hole 284 aligned with pivot hole 308.

According to the form shown, returning device 28 further includes a substantially cylindrical rotatable member 280 having a rib 288 on an intermediate portion of an outer periphery thereof. Two pivotal sections 290 are formed on opposite sides of rib 288. Also formed on the outer periphery of rotatable member 280 are first and second blocks 286 adjacent two ends of rib 288. A slit 294 is formed between rib 288 and first block 286. Rotatable member 280 further includes a non-circular hole 292 through which engaging portion 244 of handle 24 extends. Pivotal sections 290 are respectively and pivotably received in pivot hole 308 of body 296 and axial hole 284 of housing 282 with blocks 286 located between limiting blocks 304. The spacing between limiting blocks 304 and blocks 286 limits rotation of rotatable member 280.

According to the form shown, returning device 28 further includes an elastic element 312 in the form of a spiral spring having a spiral section, a first tang 314 outside of the spiral section, and a second tang 316 inside of the spiral section. The spiral section of elastic element 312 is mounted around limiting blocks 304 and are located in compartment 298, with first tang 314 abutting against a wall of engaging groove 302 and with second tang 316 received in slit 294 of rotatable member 280 and abutting against a side of first block 286 adjacent to slit 294. Thus, first tang 314 is fixed to body 296, and second tang 316 is fixed in slit 294. Rotatable member 280 is biased by elastic element 312 such that each of first and second blocks 286 presses against end 306 of one of limiting blocks 304. In this state, stem 240 of handle 24 is in a horizontal state with rotatable member 280 in its initial position. When rotatable member 280 is rotated, first block 286 adjacent to slit 294 presses against second tang 316 of elastic element 312 to store the restoring force.

In the form shown, rotatable member 280 of returning device 28 operates in a single direction according to the moving direction of unlocking member 148 and push rod 144. Specifically, rotatable member 280 can only rotate jointly with unlocking member 148 in the counterclockwise direction in FIG. 3. Clockwise rotation of rotatable member 280 is stopped by one of limiting blocks 304.

Returning device 28 is received in opening 462 of inner lid 46 and abuts against bend 466. Engaging portion 244 of handle 24 extends through non-circular hole 292 of rotatable member 280. A fastener 250 is threadedly engaged in a screw hole in an end face of engaging portion 244 and includes a head abutting against rotatable member 280, such that returning device 28 can not move along engaging portion 244. Namely, movement of returning device 28 along a rotating axis about which rotatable member 280 rotates is prevented. Thus, follower 38 and actuating member 36 are retained in place. Due to non-circular coupling between engaging portion 244 and rotatable member 280, elastic element 312 is twisted by rotatable member 280 when handle 24 is rotated. When handle 24 is released, elastic element 312 returns rotatable member 280 to its initial position and returns handle 24 to its initial, horizontal position. Limiting blocks 304 limit rotational movement of handle 24 to be smaller than 45° in either direction. According to the form shown, handle 24 can rotate 40° in a counterclockwise direction.

According to the form shown, locking mechanism 3 includes an outer cylinder 26 including a cylindrical outer cylinder body 264 having a flange 262 on an end thereof. An end of an outer periphery of outer cylinder body 264 includes a threaded portion 266. An axial bore 261 extends from an end face of the other end of outer cylinder body 264 and has a central axis parallel to but spaced from a longitudinal axis of outer cylinder body 264. The central axis of axial bore 261 is parallel to first axis X in the form shown. The outer periphery of outer cylinder body 264 further includes two diametrically opposed V-shaped positioning grooves 268. A receiving groove 265 is defined in the outer periphery of outer cylinder body 264, is spaced from axial bore 261, and extends in a direction parallel to the central axis of axial bore 261. Receiving groove 265 is spaced from each positioning groove 268 by 90°. A plurality of upper tumbler pin holes 263 extends along second axis Y to axial bore 261. Upper tumbler pin holes 263 are spaced from each other along first axis X.

Locking mechanism 3 further includes an outer lock core 270 received in outer cylinder body 264 and having an enlarged head 271 on an end thereof. A tail 279 is provided at the other end of outer lock core 270 and has an outer diameter smaller than the outer diameter of enlarged head 271. A keyway 275 extends from enlarged head 271 to tail 279. Outer lock core 274 further includes a plurality of lower tumbler pin holes 274 spaced from each other along first axis X and formed in an outer periphery of outer lock core 270. Each lower tumbler pin hole 274 extends from the outer periphery of outer lock core 270 to keyway 275. Two screw holes 273 are formed in an end face of the other end of outer lock core 270 and are located on opposite sides of tail 279. Outer lock core 270 is rotatably received in axial bore 261 of outer cylinder body 264, with tail 279 located outside of axial bore 261 and with enlarged head 271 abutting an end face of outer cylinder body 264 in which an end of axial bore 261 is located. Each lower tumbler pin hole 274 is aligned with one of the upper tumbler pin holes 263.

Outer cylinder 26 is received in compartment 206 of cover 20 with flange 262 abutting a bottom wall of compartment 206. Outer cylinder body 264 extends through opening 208 of cover 20 and second hole 104 of door 10 into mounting hole 105 of door 100. Threaded portion 266 is received in case 122 and engages with one of mounting holes 122A. Each positioning groove 268 engages with one of two protrusions 121 of lock 12.

Locking mechanism 3 further includes an actuating block 755 engaged with tail 279 of outer lock core 270. Specifically, actuating block 755 includes a base 757. A lug 759 extends radially outward from an outer periphery of base 757. Two fasteners 269 extend through base 757 and engage with screw holes 273 of outer lock core 270. Thus, actuating block 755 and outer lock core 270 rotate jointly about the central axis of axial bore 261. Actuating block 755 prevents outer lock core 270 from disengaging from outer cylinder 26 along the center axis of axial bore 261.

According to the form shown, a lower tumbler pin 251, an upper tumbler pin 252, and a spring 253 are received in each pair of aligned upper and lower tumbler pin holes 263 and 274. A lid 254 is mounted in receiving groove 265 to prevent disengagement of lower tumbler pins 251, upper tumbler pins 252, and springs 253. Each spring 253 includes a first end pressing against lid 254 and a second end pressing against a corresponding upper tumbler pin 252, assuring that the corresponding upper tumbler pin 252 presses against a corresponding lower tumbler pin 251, and assuring that the corresponding lower tumbler pin 251 extends into a corresponding lower tumbler pin hole 274. Thus, outer lock core 270 can not be rotated without inserting a key into axial bore 261 and rotating the key. Upper tumbler pins 252 can have different lengths, and lower tumbler pins 251 can have different lengths, providing various combinations for keys.

According to the form shown, locking assembly 3 further includes an inner cylinder 50 including an inner cylinder body 52 having front and rear end faces 521 and 523 and an axial bore 520 extending from front end face 521 through rear end face 521. Axial bore 520 includes a central axis parallel to and spaced from a longitudinal axis of inner cylinder body 52. A flange 524 is formed around front end face 521. Two screw holes 525 are defined in rear end face 523. Inner cylinder body 52 further includes a receiving groove 528 in an outer periphery thereof and parallel to but spaced from axial bore 520. A plurality of upper tumbler pin holes 526 extends from a bottom wall of receiving groove 528 along second axis Y into axial bore 520. Upper tumbler pin holes 526 are spaced from each other along first axis X.

An inner lock core 54 is received in axial bore 520 of inner cylinder body 52 and includes an enlarged head 540 on an end thereof. A tail 542 is provided at the other end of inner lock core 540 and has an outer diameter smaller than the outer diameter of enlarged head 540. Tail 542 has an annular groove 546 in an outer periphery thereof. A groove 543 extends from an end face of tail 542 toward but spaced from enlarged head 540 along first axis X and intersects with annular groove 546. Inner lock core 54 further includes a keyway 544 extending from enlarged head 540 through tail 542. Inner lock core 54 further includes a plurality of lower tumbler pin holes 548 spaced from each other along first axis X and formed in an outer periphery of inner lock core 54. Each lower tumbler pin hole 548 extends from the outer periphery of inner lock core 540 to keyway 548. Inner lock core 54 is rotatably received in axial bore 520 of inner cylinder body 52, with tail 542 located outside of axial bore 520 and with enlarged head 540 abutting front end face 521 of inner cylinder body 520. Each lower tumbler pin hole 548 is aligned with one of the upper tumbler pin holes 526.

According to the form shown, a lower tumbler pin 560, an upper tumbler pin 562, and a spring 564 are received in each pair of aligned upper and lower tumbler pin holes 526 and 548. A lid 566 is mounted in receiving groove 528 to prevent disengagement of lower tumbler pins 560, upper tumbler pins 562, and springs 564. Each spring 564 includes a first end pressing against lid 566 and a second end pressing against a corresponding upper tumbler pin 562, assuring that the corresponding upper tumbler pin 562 presses against a corresponding lower tumbler pin 560, and assuring that the corresponding lower tumbler pin 560 extends into a corresponding lower tumbler pin hole 548. Thus, outer lock core 54 can not be rotated without inserting a key into axial bore 520 and rotating the key. Upper tumbler pins 562 can have different lengths, and lower tumbler pins 560 can have different lengths, providing various combinations for keys.

Figure 11:
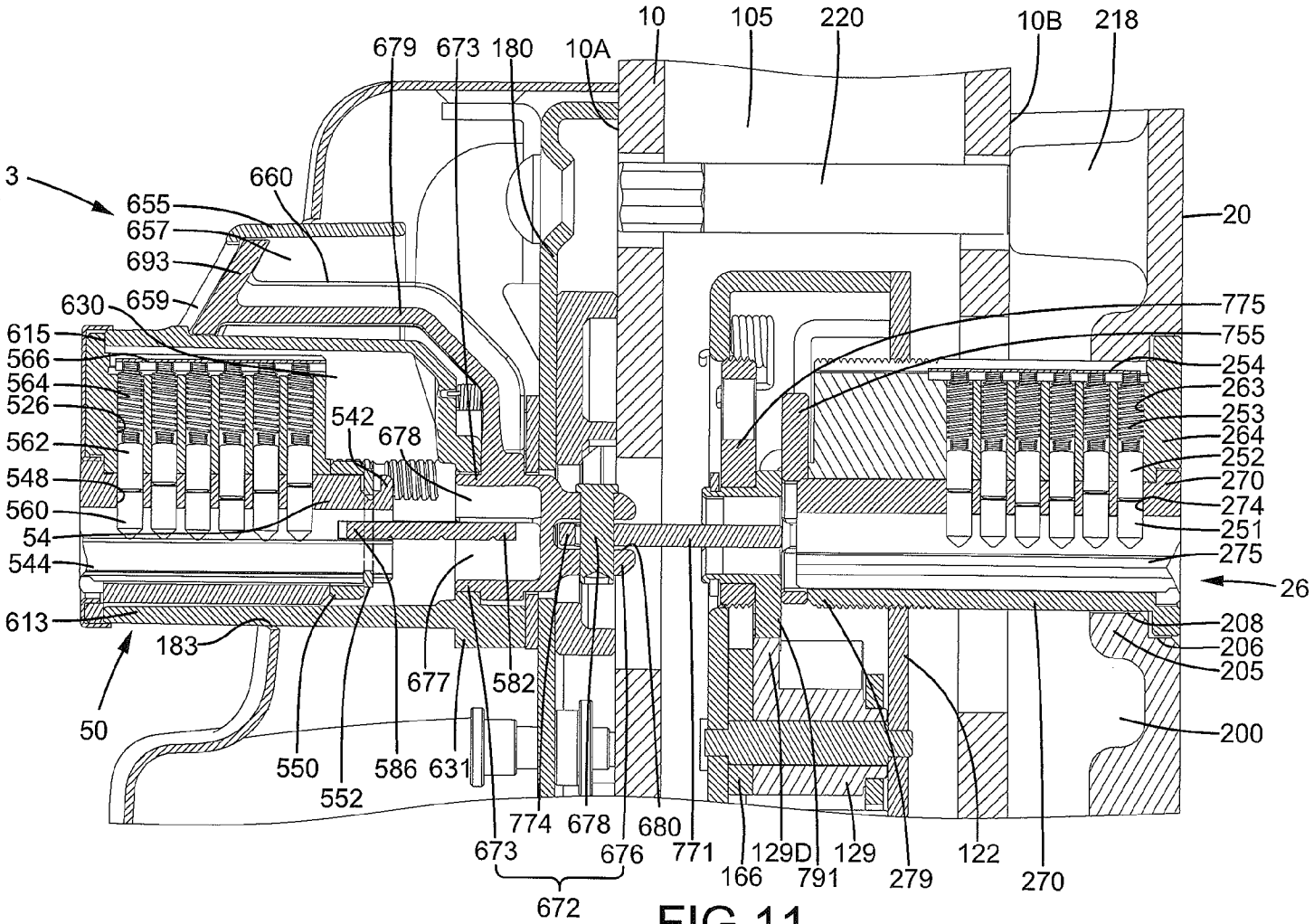
FIG. 11 is a cross sectional view taken along section line 11-11 of FIG. 5.
Figure 12:
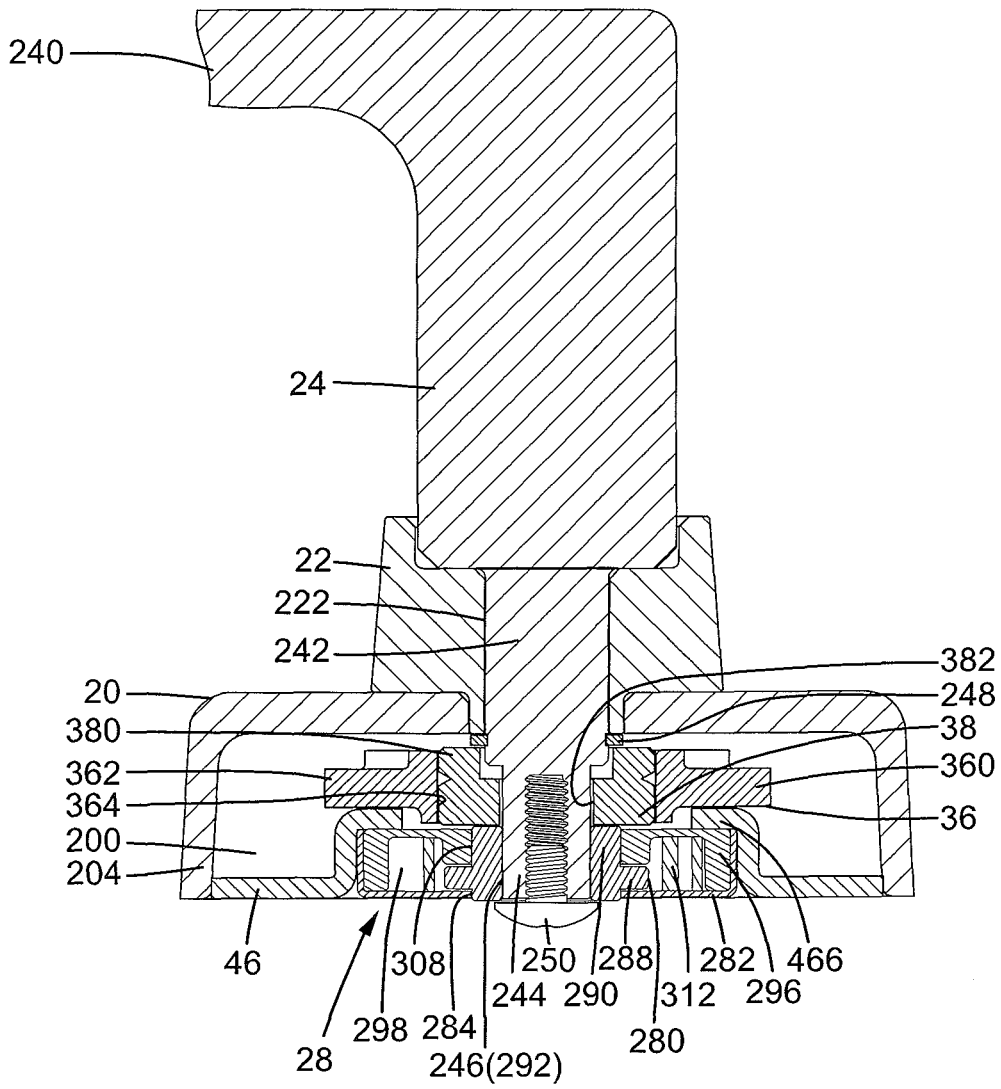
FIG. 12 is a cross sectional view taken along section line 12-12 of FIG. 6.
Figure 13:
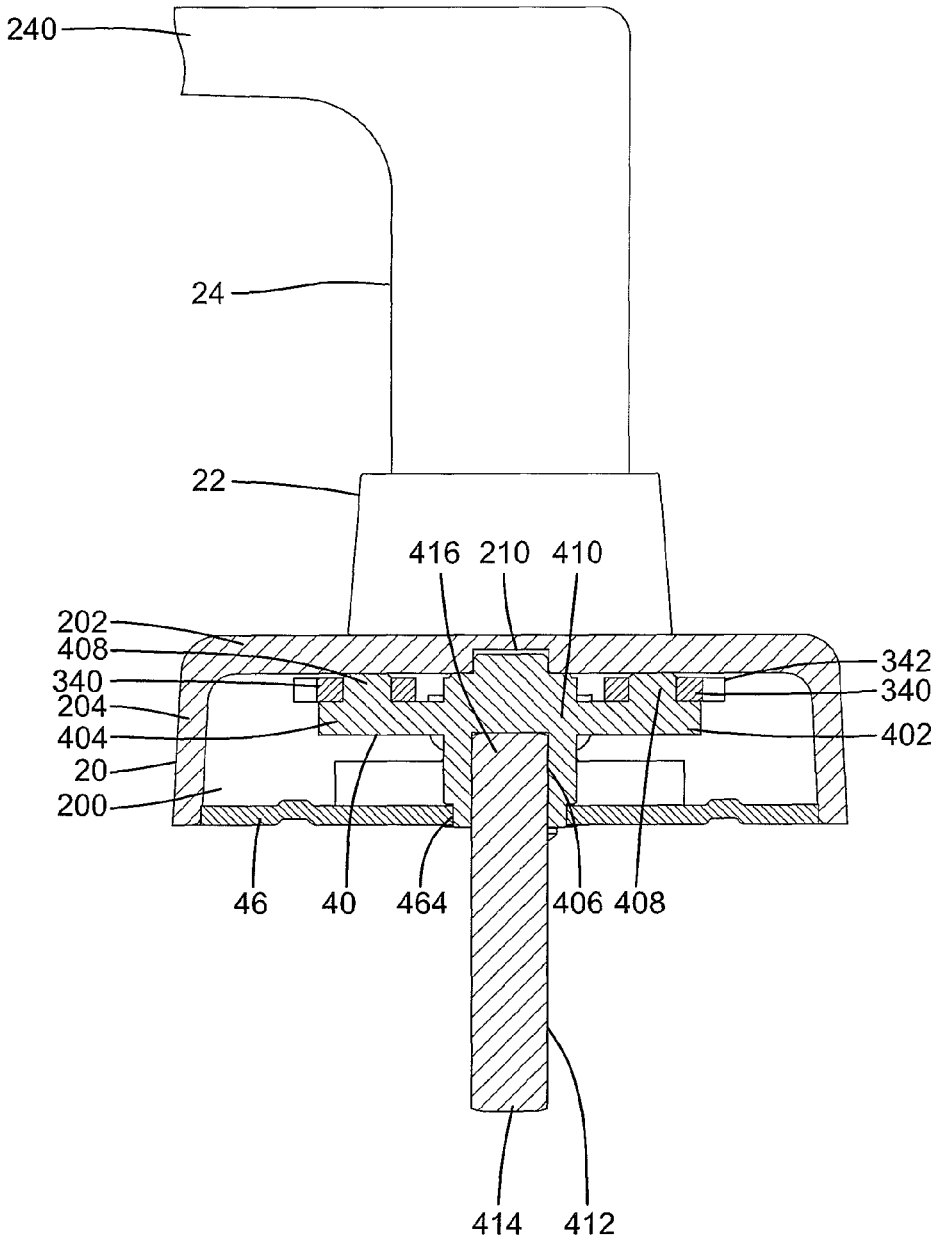
FIG. 13 is a cross sectional view taken along section line 13-13 of FIG. 6.

According to the form shown, locking assembly 3 further includes a tongue 58 having front and rear ends 582 and 584 spaced from each other in a longitudinal direction parallel to first axis X. Rear end 584 includes an ear 586 on each of two sides thereof. Each ear 586 has a width slightly smaller than a diameter of tail 542 of inner lock core 54. Tongue 58 includes an upper face with a plurality of slots 588 between front and rear ends 582 and 584 and spaced from each other at regular intervals. Ears 586 of rear end 584 are received in groove 543 of inner lock core 54. A positioning ring 550 is mounted around inner lock core 54 between groove 543 and lower tumbler pin holes 548. A retainer ring 552 is engaged in annular groove 546 of inner lock core 54 to position positioning ring 550 between retainer ring 552 and rear end face 523 of inner cylinder body 52. Positioning ring 550 prevents ears 586 of tongue 58 from extending out of groove 543 of inner lock core 54. Retainer ring 552 retains ears 586 of tongue 58 in a position behind annular groove 546, preventing tongue 58 from disengaging from groove 543 of inner lock core 54. Thus, tongue 58 is reliably fixed to inner lock core 54 (FIG. 11).

According to the form shown, locking mechanism 3 further includes an inner cylinder seat 613 receiving inner cylinder 50. Inner cylinder seat 613 includes a first end face 615 and a second end face 617 spaced from first end face 615 along first axis X. Inner cylinder seat 613 further includes a peripheral wall 619 extending from first end face 615 through second end face 617 along first axis X. Inner cylinder seat 613 further includes a first compartment 630 extending from first end face 615 through second end face 617. A shield 655 is provided on peripheral wall 619 and defines a second compartment 657. Shield 655 includes a wall adjacent to first end face 615. A window 659 is defined in the wall of shield 655. Window 659 extends to and is in communication with second compartment 657. Inner cylinder seat 613 further includes a pivotal portion 631 extending from second end face 617 away from first end face 615 along first axis X. Pivotal portion 631 includes a third end face 633, with the second end face 617 located between first end face 615 and third end face 633 along first axis X. Pivotal portion 631 further includes a pivotal hole 635 extending from third end face 633 to first compartment 630 along first axis X. Pivotal portion 631 further includes a notch 638 formed in an upper end of pivotal portion 631 and extending to pivotal hole 635. An engagement hole 653 is defined in second end face 617. Two screw holes 654 are defined in second end face 617 and are located on two sides of notch 638, with a longitudinal axis of pivotal hole 635 located between screw holes 654. Flange 524 of inner cylinder body 52 abuts first end face 615 of inner cylinder seat 613. Tongue 58 extends outside of third end face 633 of inner cylinder seat 613.

Figure 3:
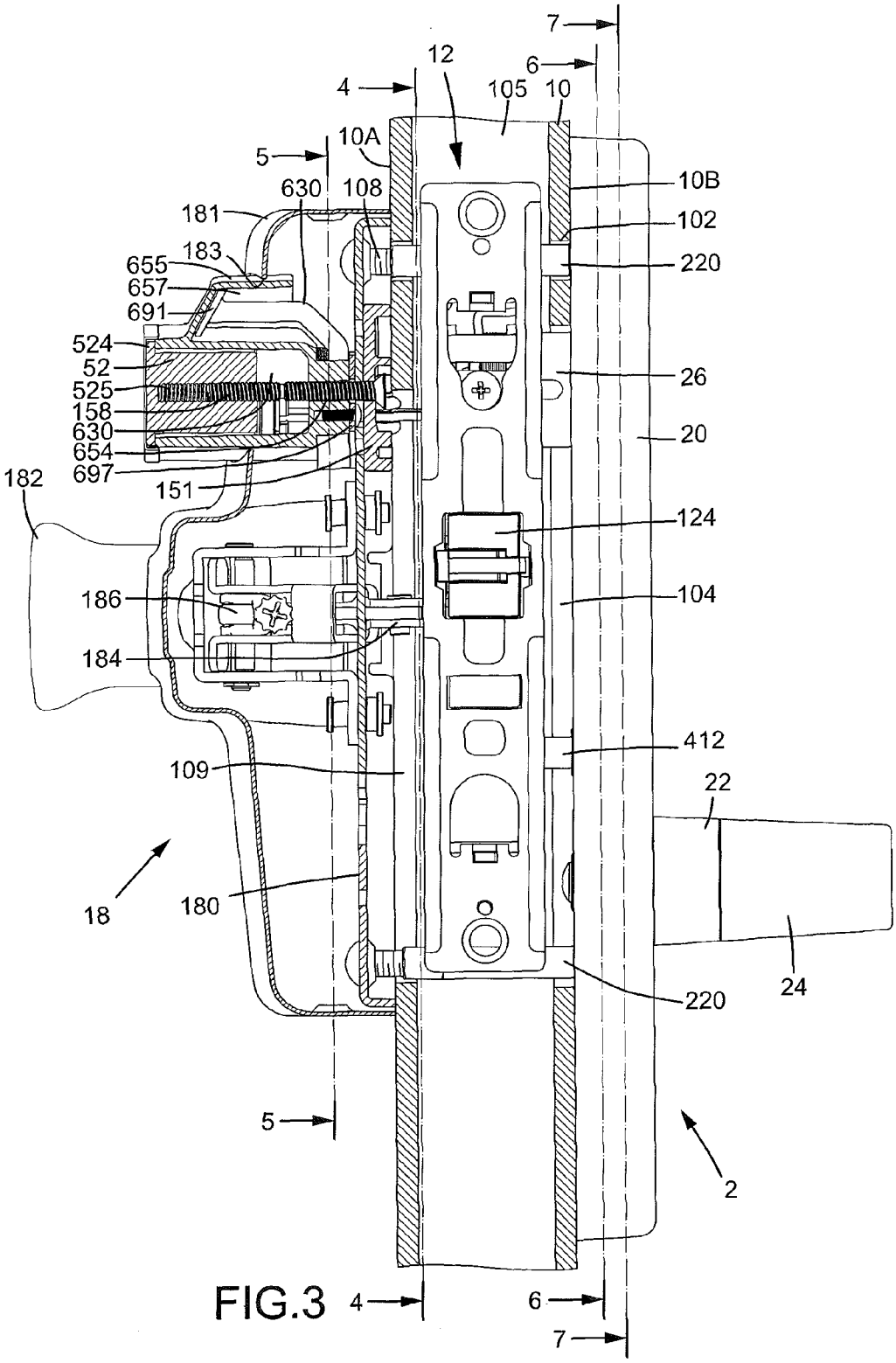
FIG. 3 is a cross sectional view taken along section line 3-3 of FIG. 2.
Figure 5:
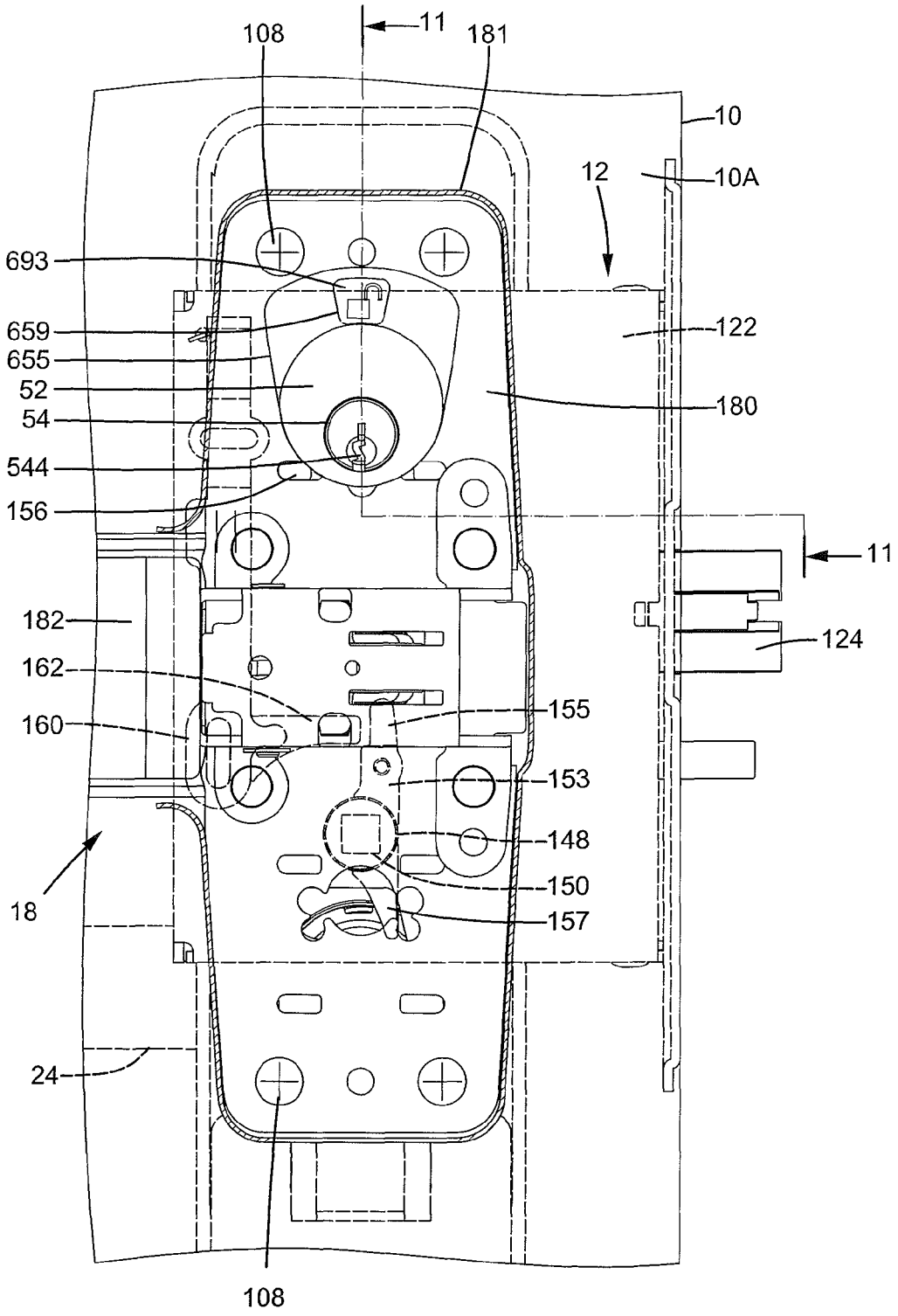
FIG. 5 is a cross sectional view taken along section line 5-5 of FIG. 3.
Figure 6:
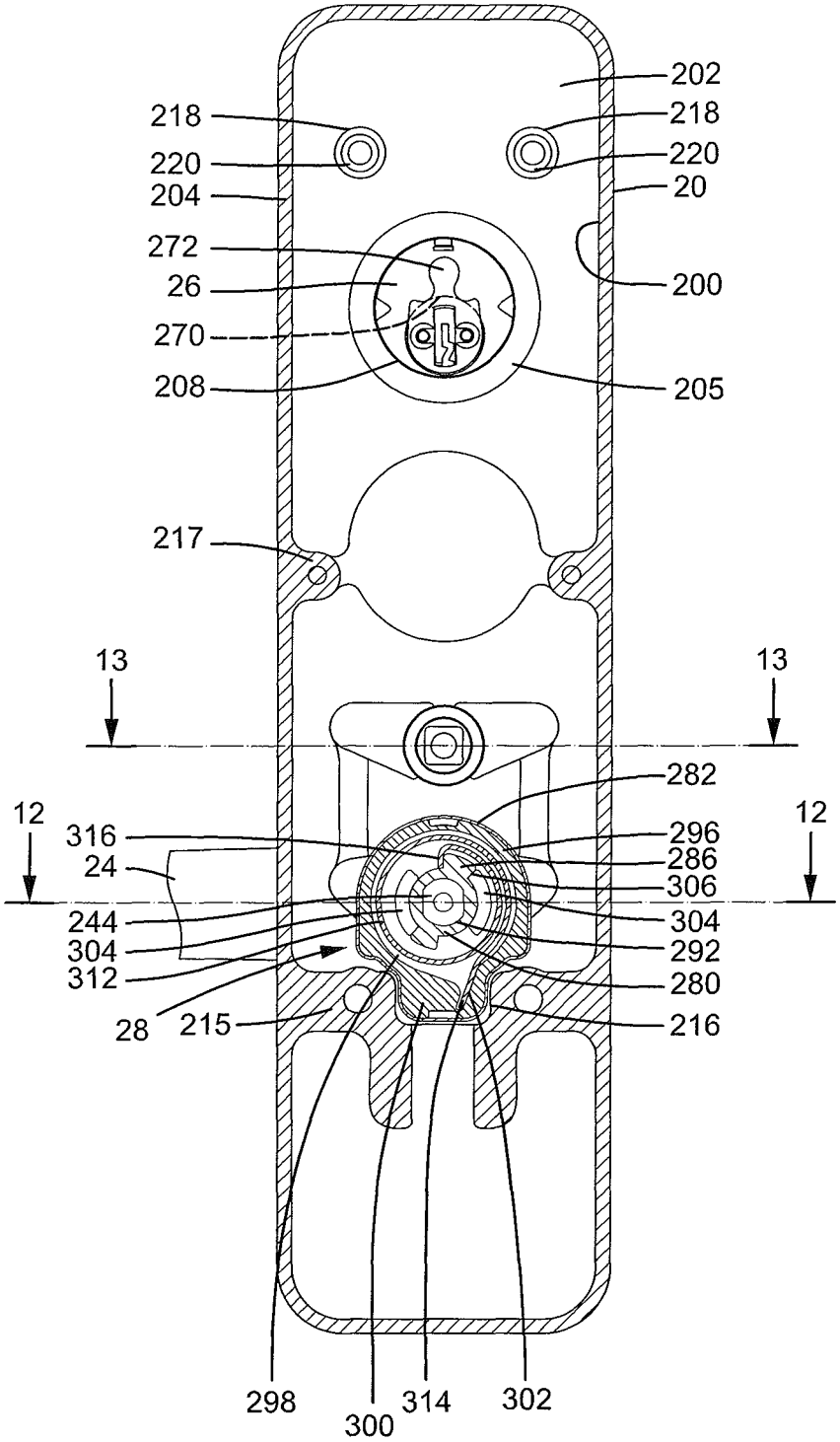
FIG. 6 is a cross sectional view taken along section line 6-6 of FIG. 3.
Figure 7:
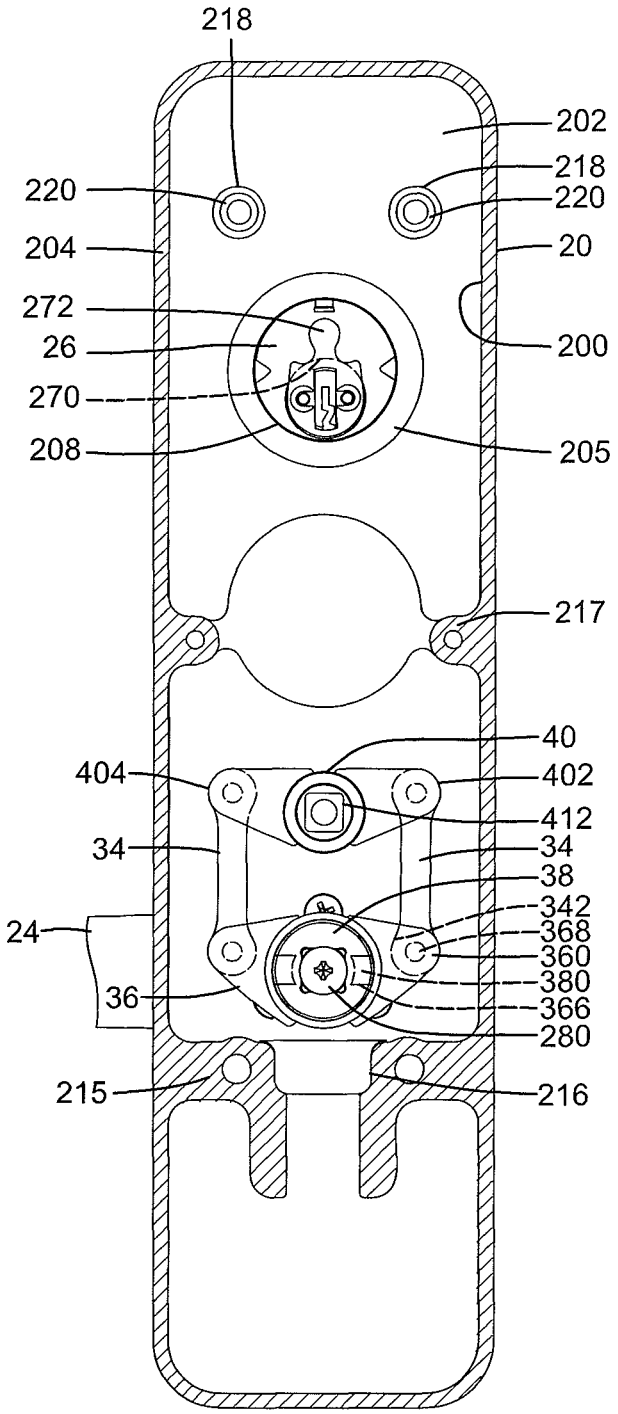
FIG. 7 is a cross sectional view taken along section line 7-7 of FIG. 3.
Figure 8:
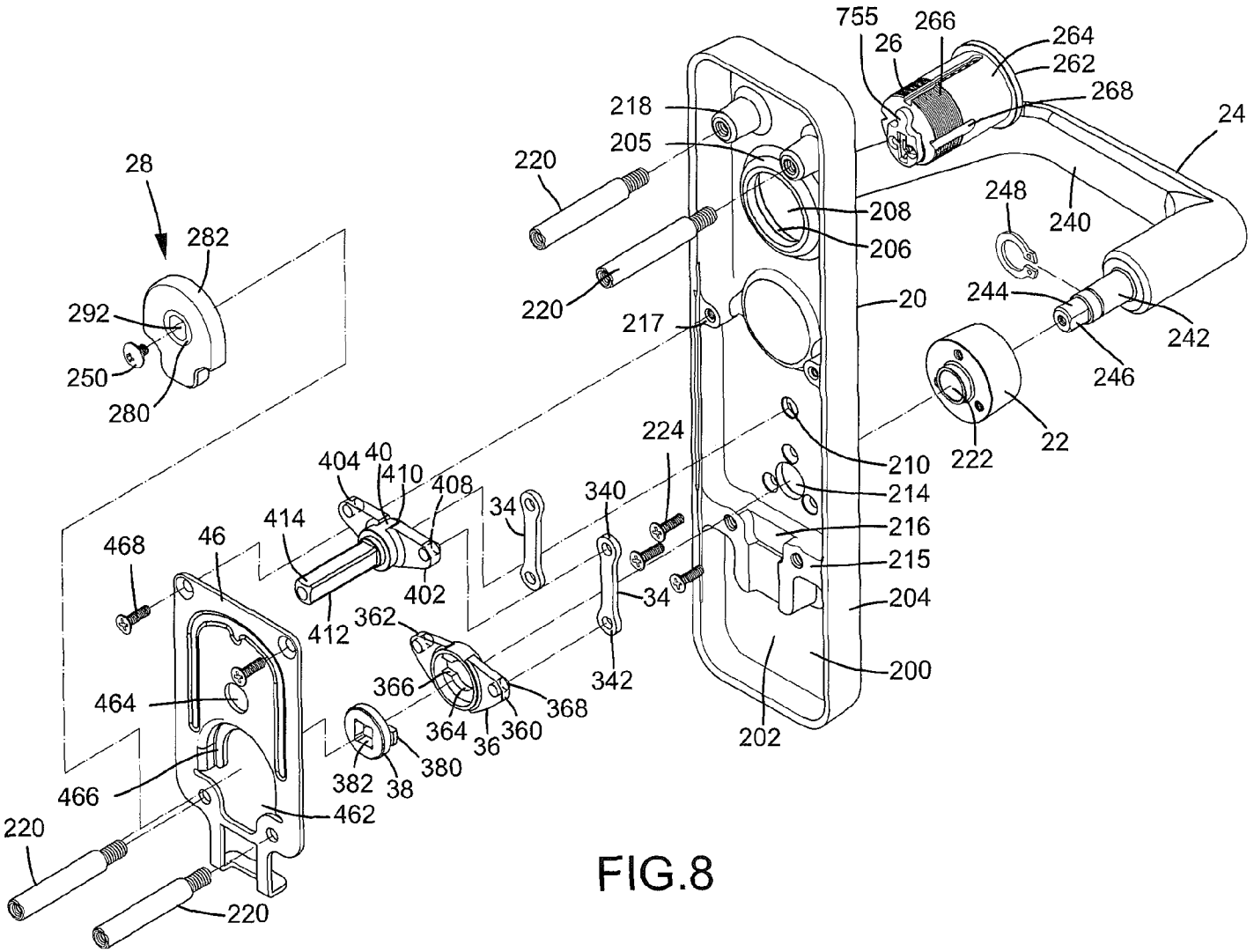
FIG. 8 is an exploded, perspective view of an outer operational device of the panic exit door lock of FIG. 1.

With reference to FIGS. 1 and 3, inner cylinder 50 is fixed by a locking plate 151 to an upper portion of base 180. According to the form shown, locking plate 151 is mounted to the other side of base 180 facing door 10. Specifically, locking plate 151 includes two holes 154 aligned with screw holes 654 of inner cylinder seat 613. Locking plate 151 further includes a through-hole 159 between holes 154. Furthermore, locking plate 151 includes a plurality of protrusions 156 in four corners of locking plate 151. Protrusions 156 are inserted into four corners of base 180 to position locking plate 151 (FIG. 5). Second end face 617 of inner cylinder seat 613 abuts a surface of base 180. Two screws 158 extend through holes 154 of locking plate 151 and screw holes 654 of inner cylinder seat 613 into screw holes 525 of inner cylinder body 52. Thus, inner cylinder 50 and locking plate 151 are fixed to base 180, with tongue 58 extending through through-hole 159 of locking plate 151.

According to the form shown, locking mechanism 3 further includes an indicator member 660 pivotably mounted to inner cylinder seat 613. Indicator member 660 includes a pivotal portion 672 having a first section 673 and a second section 676 spaced from first section 673 along first axis X. Second section 676 is substantially U-shaped and includes an engagement groove 680 in an end face thereof. Pivotal portion 672 further includes an engagement hole 677 extending from an end face of first section 673 toward but spaced from an end face of second section 676 along first axis X. Engagement hole 677 has non-circular cross sections. Indicator member 660 further includes an arm 679 formed on an outer periphery of pivotal portion 672. An indicator 691 is formed on a distal end of arm 679 and includes a first portion 693 indicating locking member 160 is in the unlocking position and a second portion 695 indicating locking member 160 is in the locking position. First section 673 of indicator member 660 is pivotably received in pivotal hole 635 of inner cylinder seat 613. Engagement groove 680 of second section 676 of indicator member 660 is engaged with an engagement end 774 of an actuating plate 771 via a pin 678. Actuating plate 771 further includes an actuating end 773 located outside of second section 676 of indicator member 660. Pivotal movement of indicator member 660 between two positions causes selective alignment of first portion 693 or second portion 695 of indicator 691 with window 659.

According to the form shown, a spring 739 is mounted between indicator member 660 and inner cylinder seat 613. Spring 739 includes a first tang 751 and a second tang 753. First tang 751 of spring 739 is engaged in engagement hole 653 of inner cylinder seat 613. Second tang 753 of spring 739 presses against arm 679 of indicator member 660. Spring 739 biases indicator member 660 to a position in which first portion 693 or second portion 695 of indicator member 660 is aligned with window 659. A limiting plate 697 is screwed to third end face 633 of inner cylinder seat 613 and includes a through-hole 699 aligned with pivotal hole 635 of inner cylinder seat 613. Second section 675 of indicator member 660 extends through through-hole 699 of limiting plate 697, preventing indicator member 660 from moving along first axis X.

According to the form shown, locking mechanism 3 further includes a support plate 775 mounted in mounting hole 122A and a setting member 791 pivotably connected to support plate 775 and located in case 122. Support plate 775 includes two diametrically opposed V-shaped notches 777 in an outer periphery thereof. Each notch 777 engages with one of protrusions 121. Support plate 775 further includes a pivotal hole 779. Setting member 791 is pivotably mounted in pivotal hole 779 of support plate 775 and includes a hole 795 extending from a side thereof through the other side thereof. A plurality of inner protrusions 797 is formed on an inner periphery of hole 795. Setting member 791 further includes a transmission section 793 on an outer periphery thereof. In the form shown, transmission section 793 include two teeth. A retaining ring 799 is mounted around the outer periphery of setting member 791, allowing relative pivotal movement between actuating plate 771 and support plate 775. Actuating end 773 of actuating plate 771 extends into hole 795 of setting member 791, with transmission section 793 of setting member 791 meshed with toothed portion 129D of transmission block 129, allowing joint pivotal movement of setting member 791 and transmission block 129.

During installation of outer operational device 2, driving rod 412 extends through hole 150 of unlocking member 148 of lock 12, as mentioned above. Thus, even if outer operational device 2 is not aligned with lock 12 during installation, adjustment of positions of lock 12 and inner and outer operational devices 18 and 2 is not required, allowing convenient on-site installation.

Now that the basic construction of the panic exit door lock has been explained, the operation and some of the advantages of the panic exit door lock can be set forth and appreciated. In particular, for the sake of explanation, it will be assumed that handle 24 is in a horizontal position (FIGS. 2-5). Due to limitation by returning device 28, handle 24 can only pivot in the counterclockwise direction of FIG. 4. A locking function of locking mechanism 3 has not been set yet. First portion 693 of indicator 691 of indicator member 660 is aligned with window 659 of inner cylinder seat 613 (FIG. 5). Thus, a user can be aware of an unlocking state of locking mechanism 3 through window 659.

When handle 24 is pivoted in the counterclockwise direction, follower 38 and rotatable member 280 of returning device 28 rotate jointly with engaging portion 244, such that first block 286 moves second tang 316 of elastic element 312 and such that elastic element 312 is twisted to store potential energy for returning purposes. Actuating member 36 is rotated by teeth 380 of follower 38. Links 34 are driven by axles 368 of actuating member 36 to move in a reverse direction. One of links 34 moves upward to push first wing 402, and the other link 34 moves downward to push second wing 404, such that driving member 40 rotates in the counterclockwise direction. At the same time, driving rod 412 rotates jointly with driving member 40. Since stop 162 of locking member 160 is aligned with groove 155 of unlocking member 148, when front end 414 of driving rod 412 actuates unlocking member 148 of lock 12 to move in the counterclockwise direction, first arm 153 drives push rod 144 to rotate, and stop 162 enters groove 155 of unlocking member 148. Furthermore, end 146 of push rod 144 pushes retractor 120 to move in a leftward direction in FIG. 4 to compress spring 125. When rotatable member 280 rotates to an extreme position in which one of first and second blocks 286 abuts against end 306 of one of limiting blocks 304, latch 124 is moved from the latching position to the unlatching position (FIG. 15).

Figure 15:
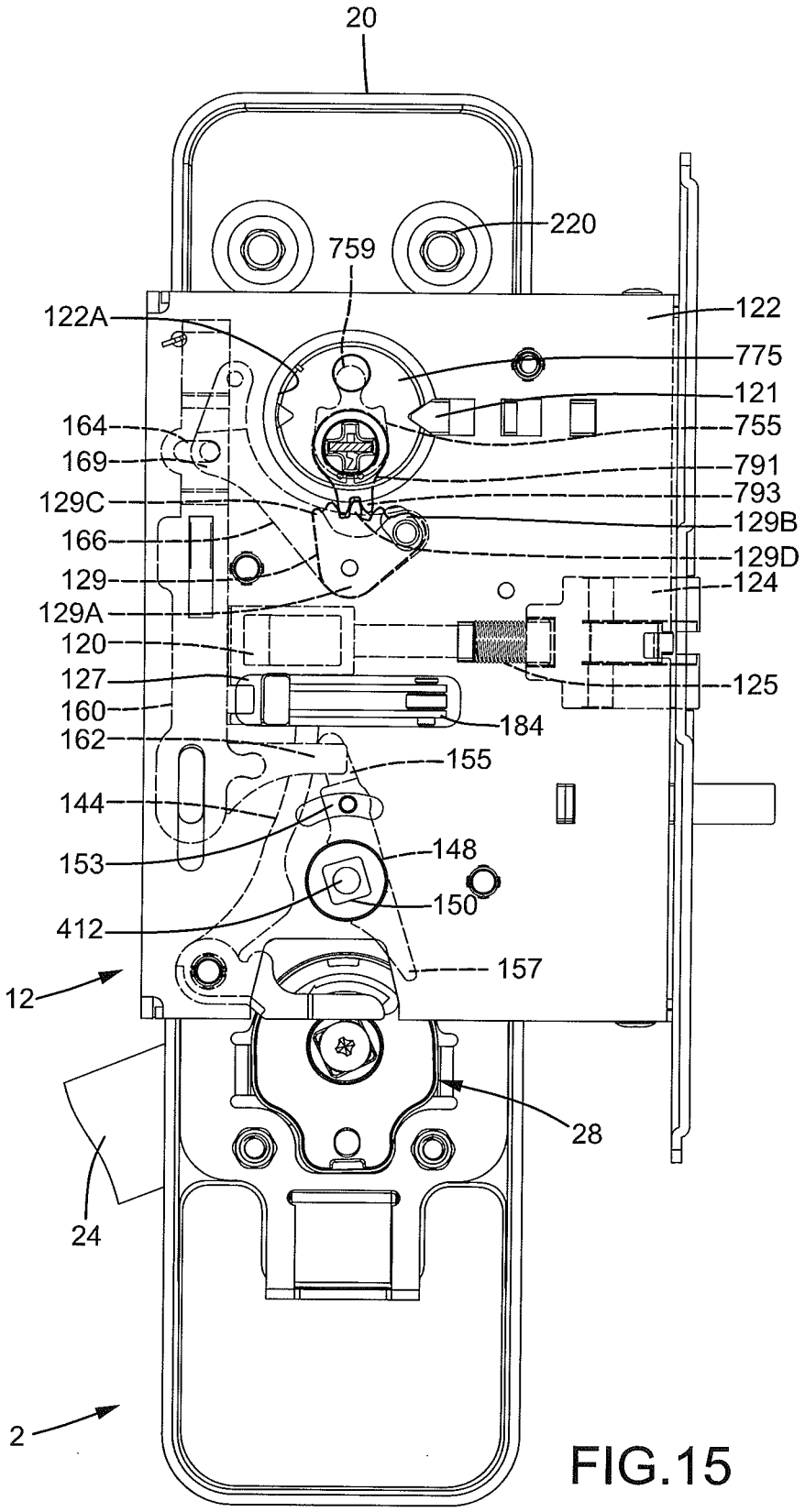
FIG. 15 is a view similar to FIG. 4, with a handle rotated for unlatching purposes.
Figure 16:
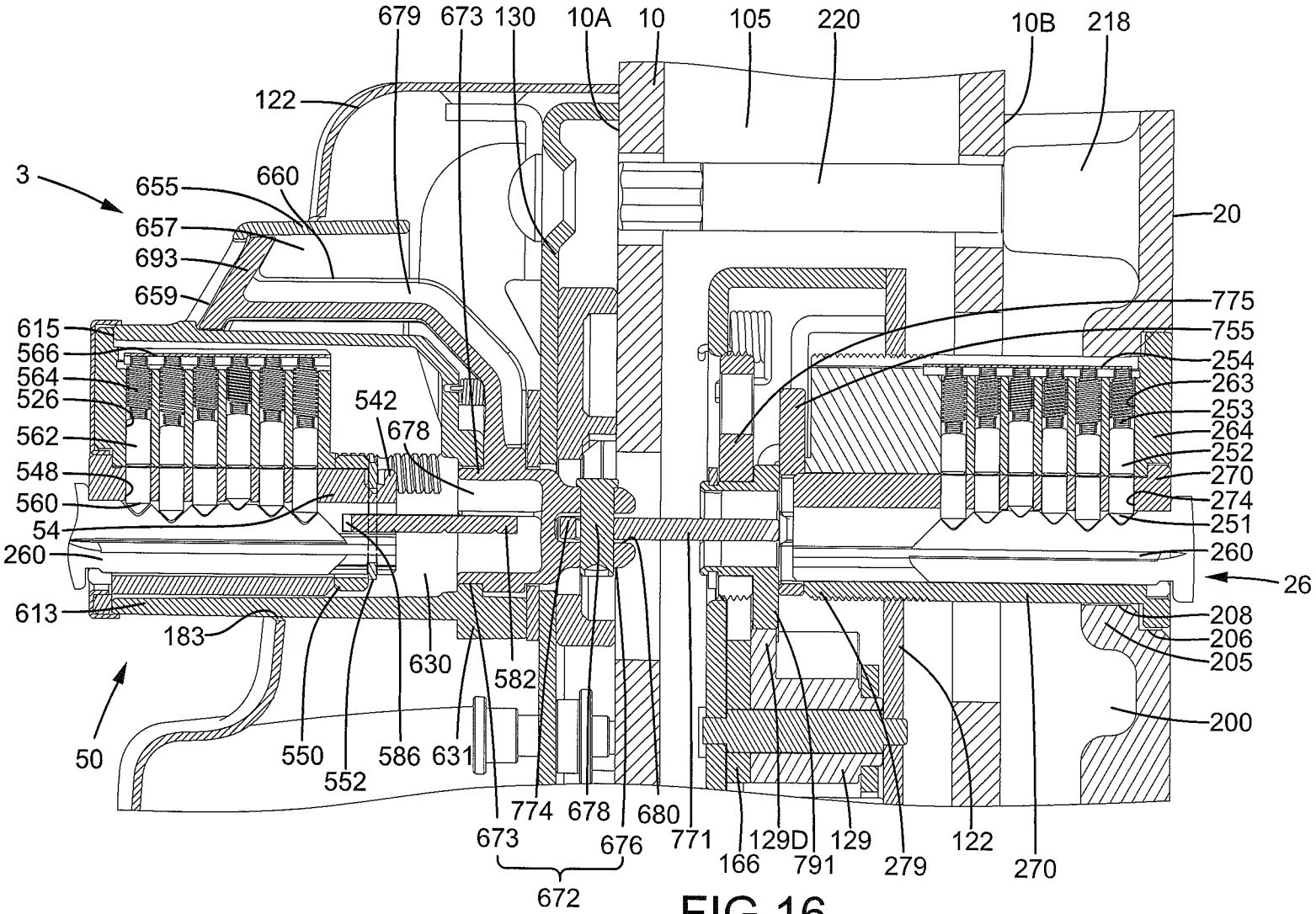
FIG. 16 is a view similar to FIG. 11, with keys inserted into the inner cylinder and an outer cylinder of the locking mechanism.

When handle 24 is released after unlatching, second tang 316 of elastic element 312 returns rotatable member 280 from the extreme position back to the initial position, which, in turn, rotates handle 24 in a clockwise direction in FIG. 15 to its initial position via engaging portion 244. Thus, stem 240 of handle 24 returns to its horizontal position, and first and second ends 360 and 362 of actuating member 36 are at the same level. Furthermore, latch 124 is moved by spring 125 to the latching position. At the same time, links 34 move first wing 402 and second wing 404 in opposite directions until first and second wings 402 and 404 are at the same level.

Figure 4:
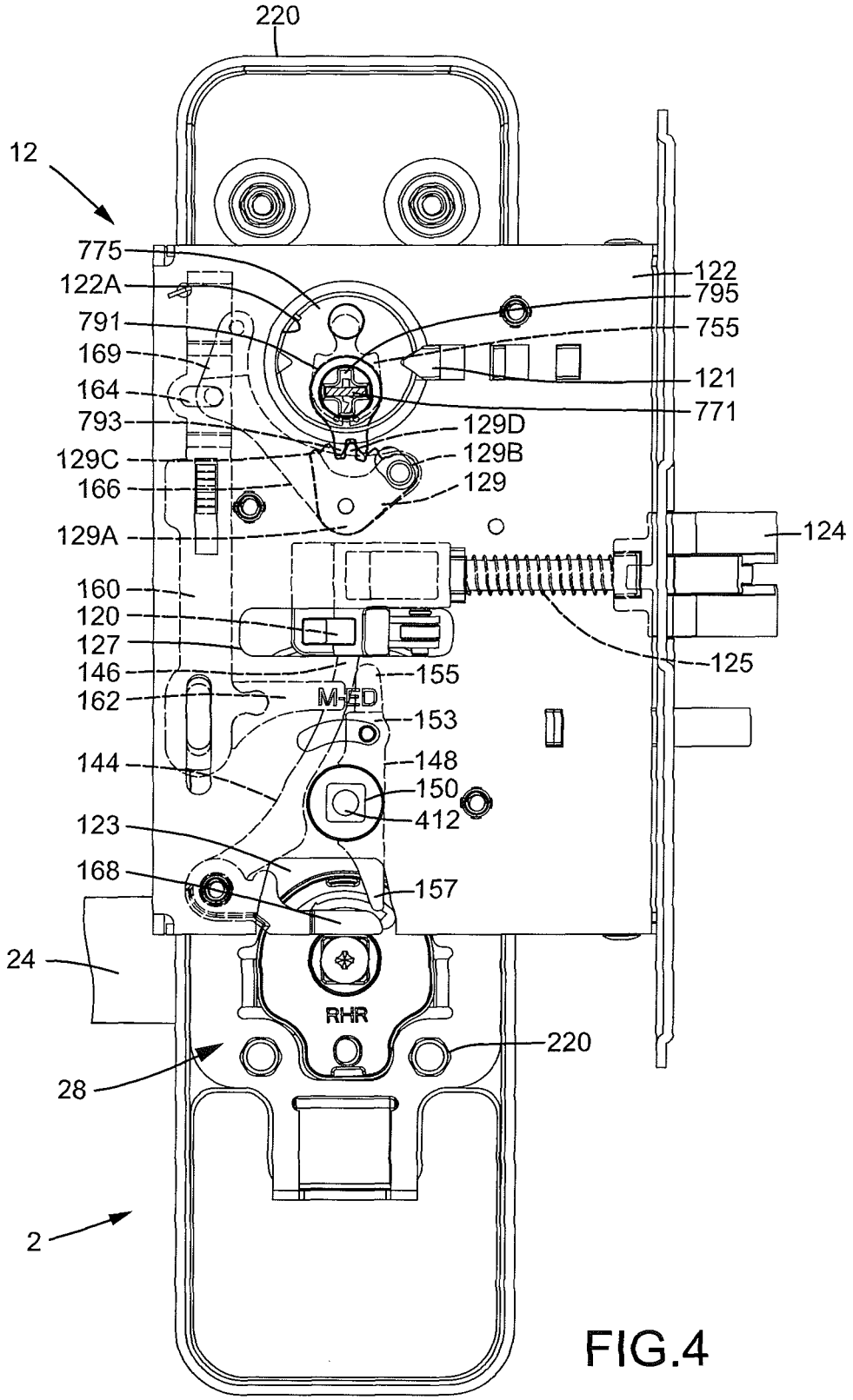
FIG. 4 is a cross sectional view taken along section line 4-4 of FIG. 3.
Figure 17:
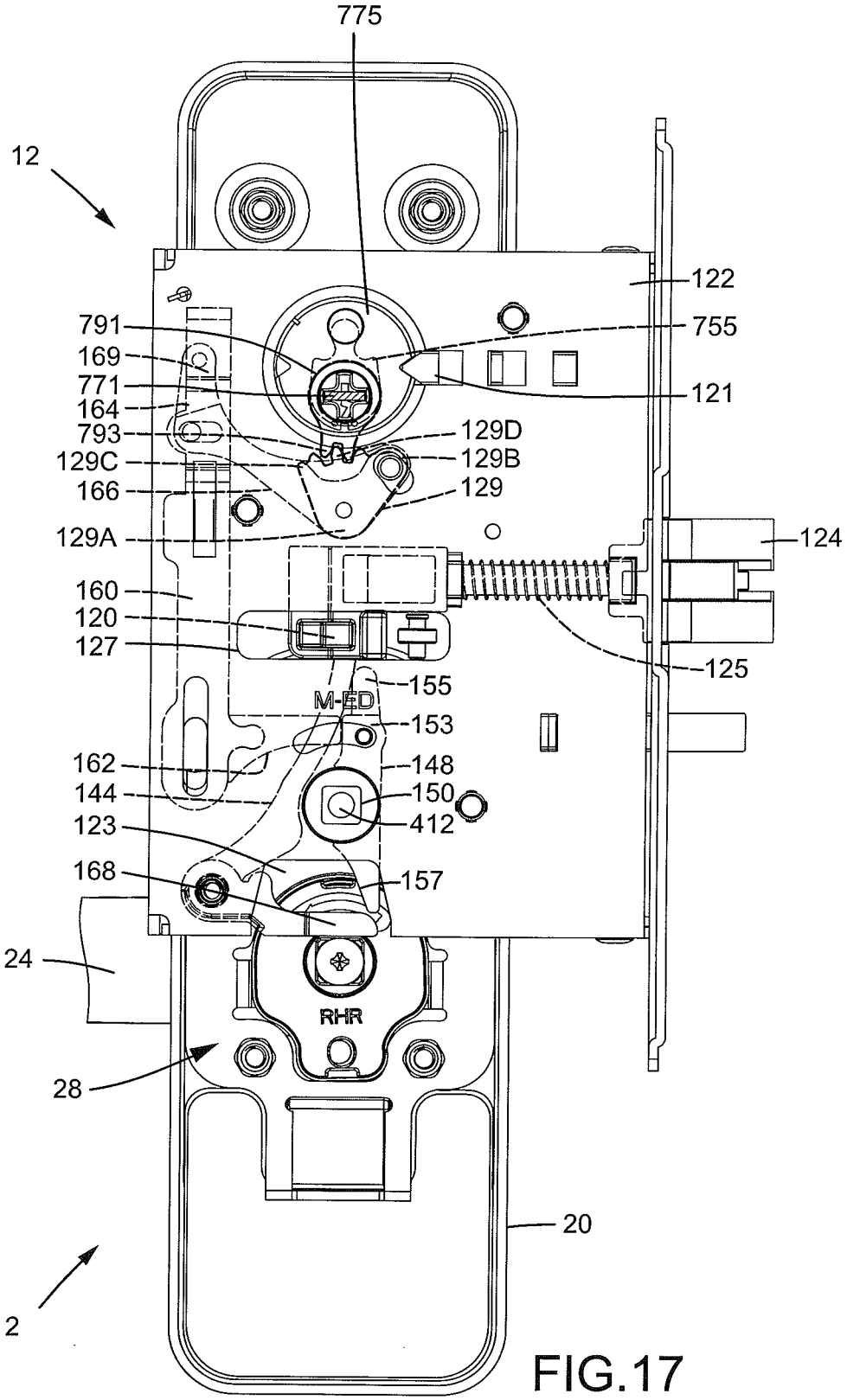
FIG. 17 is a view similar to FIG. 4, with a locking member moved from an unlocking position to a locking position.

It can be appreciated that locking mechanism 3 provides a locking function through setting from outer operational device 2 or inner operational device 18, such that latch 124 of lock 12 can not be moved to the unlatching position by operating outer operational device 2. Specifically, actuating block 755 of outer cylinder 26 is initially located above transmission block 129 of lock 12 (FIG. 4). When it is desired to set the locking function by outer operational device 2, a key 260 is inserted into outer lock core 270 in outer cylinder 26 to unlock and rotate outer lock core 270, such that lug 759 of actuating block 755 pivots in the clockwise direction in FIG. 4 to press against second end 129C of transmission block 129. Transmission block 129 moves in the counterclockwise direction in FIG. 4, which, in turn, causes counterclockwise movement of rocker 166. End 169 of rocker 166 slides in guide slot 164 of locking member 160 and moves locking member 160 along second axis Y, such that stop 162 of locking member 160 is moved from its unlocking position (in which stop 162 is aligned with groove 155 of push arm 153) downward away from groove 155 to its locking position behind push arm 153 along second axis Y (FIGS. 17 and 18).

Figure 18:
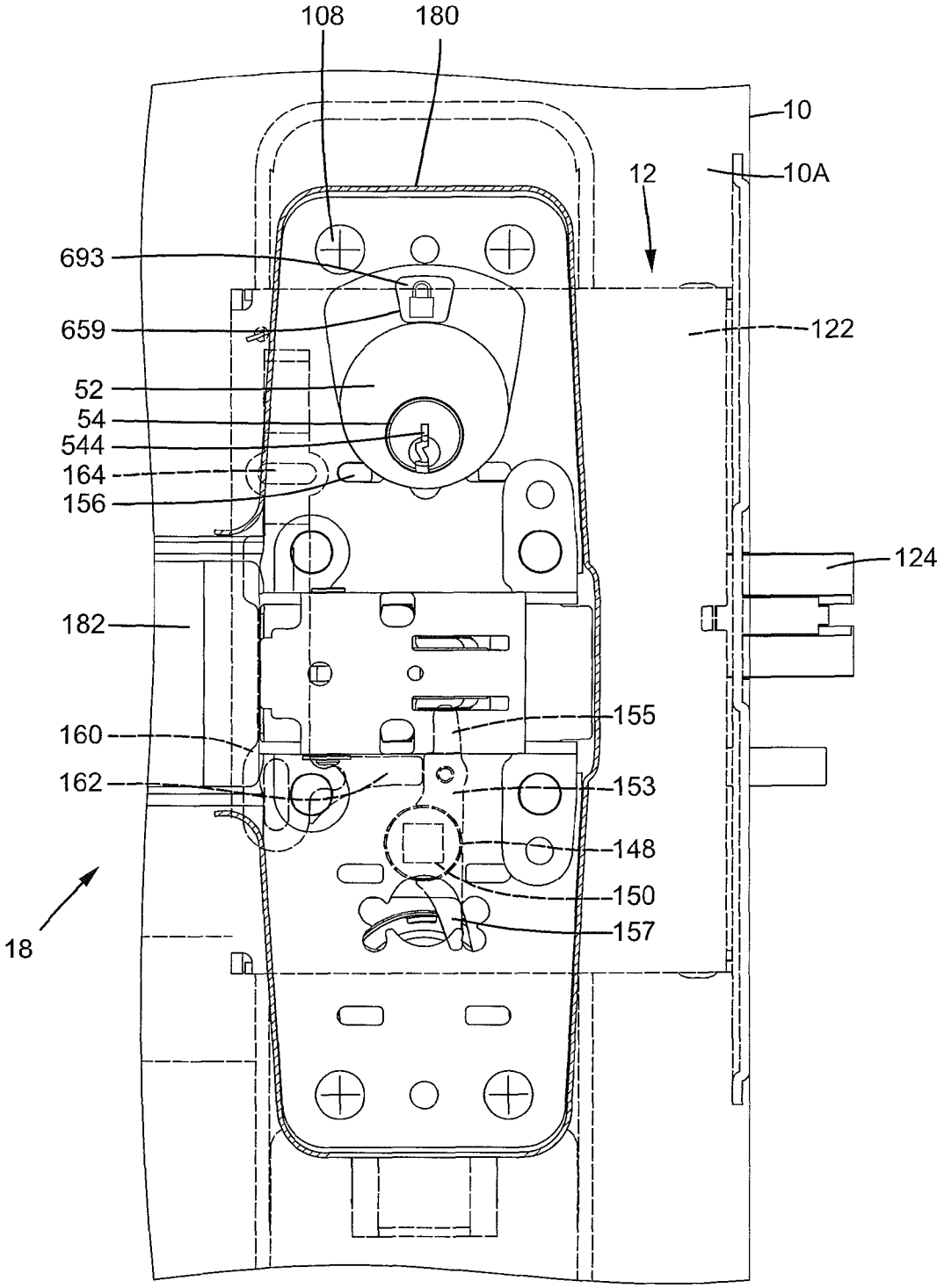
FIG. 18 is a view similar to FIG. 5, with the locking member in the locking position, and with an indicator of the locking mechanism indicating a locking state of the door lock.

When transmission block 129 pivots, toothed portion 129D of transmission block 129 drives setting member 791 to pivot, causing actuating plate 771 and indicator member 660 to pivot to a position in which second portion 695 of indicator member 660 is aligned with window 659 of inner cylinder seat 613 (FIG. 18). When locking member 160 is in its locking position (FIG. 17), stop 162 abuts a face of push arm 153, such that movement of push arm 153 of unlocking member 148 is stopped by stop 162 when handle 24 is rotated in the counterclockwise direction. Namely, unlocking door 10 by rotating handle 24 is not allowed. A user at the inner side 10A of door 10 can be aware that the locking function of lock 12 is set by indication of second portion 695 via window 659. A user at the outer side 10B can be aware that the locking function of lock 12 is set by trying to rotate handle 24 but finding that handle 24 can not be rotated.

When it is desired to remove the locking function by outer operational device 2, key 260 is inserted into outer lock core 270 in outer cylinder 26 to rotate outer lock core 270 in a reverse direction, such that lug 759 of actuating block 755 presses against first end 129B of transmission block 129, casing pivotal movement of transmission block 129 and rocker 166 in the clockwise direction and moving locking member 160 from the locking position to the unlocking position. Thus, latch 124 can be moved from the latching position to the unlatching position by rotating handle 24.

On the other hand, when it is desired to set the locking function by inner operational device 18, key 260 is inserted into inner lock core 54 in inner cylinder 50 to unlock and rotate inner lock core 54. Tongue 58 moves indicator member 660 to a position in which second portion 695 of indicator 691 is aligned with window 659 of inner cylinder seat 613. Furthermore, actuating plate 771 presses against and drives setting member 791 to pivot, moving locking member 160 from the unlocking position to the locking position, thereby setting the locking function of lock 12. Thus, handle 24 can not be rotated. In this state, unlatching can not be achieved through operation of handle 24. The user at inner side 10A of door 10 can be aware that locking mechanism 3 is in the locking state through window 659, with indicator member 660 indicating that the locking function of lock 12 is set.

When it is desired to remove the locking setting by inner operational device 18, key 260 is inserted into inner lock core 54 in inner cylinder 50 to unlock and rotate inner lock core 54 in the counterclockwise direction. This causes clockwise pivotal movement of setting member 791 and rocker 166 and moves the locking member 160 from the locking position to the unlocking position such that latch 124 can be moved from the latching position to the unlatching position.

Figure 2:
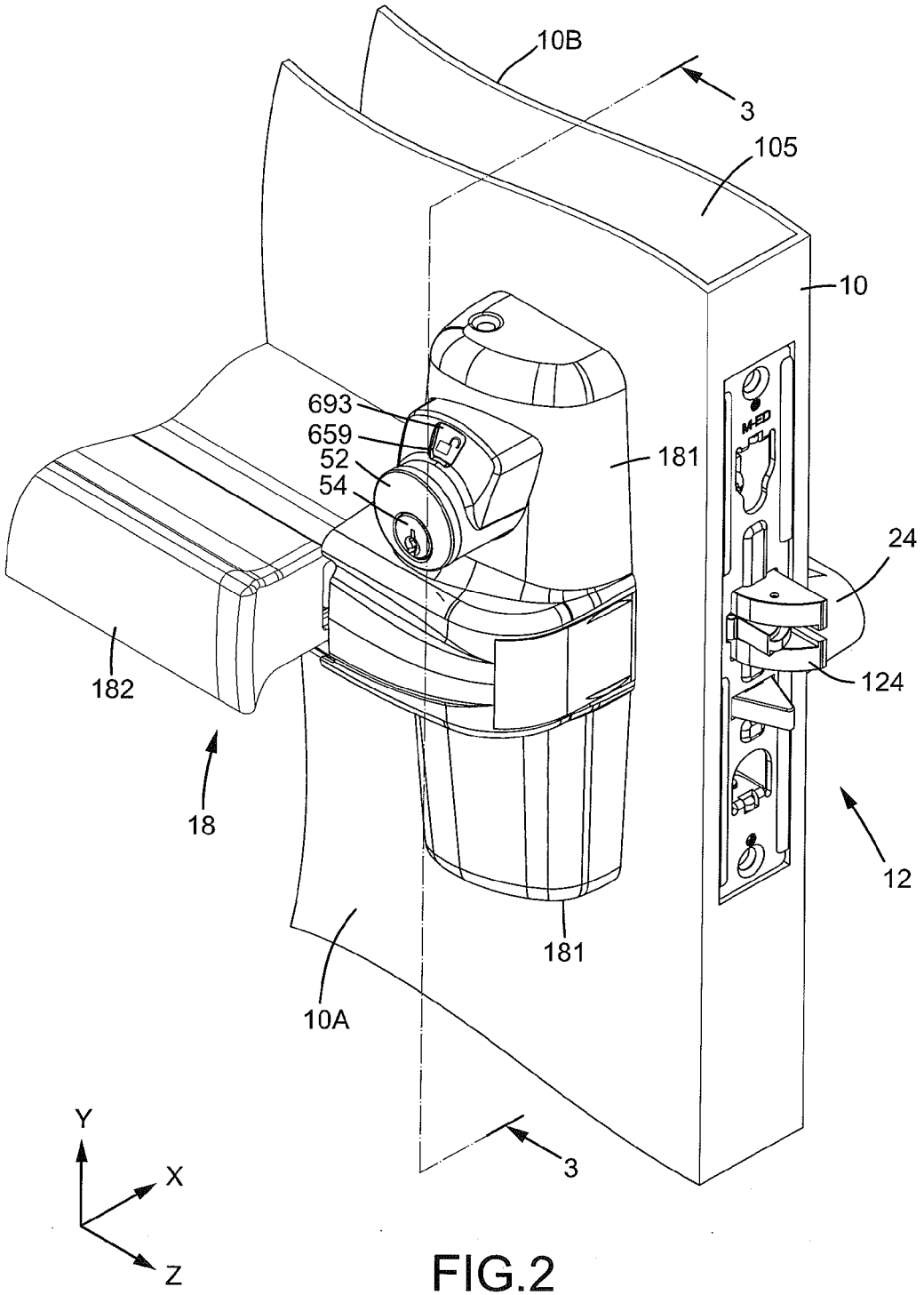
FIG. 2 is a perspective view of the panic exit door lock of FIG. 1 and a door to which the panic exit door lock is mounted.
Figure 9:
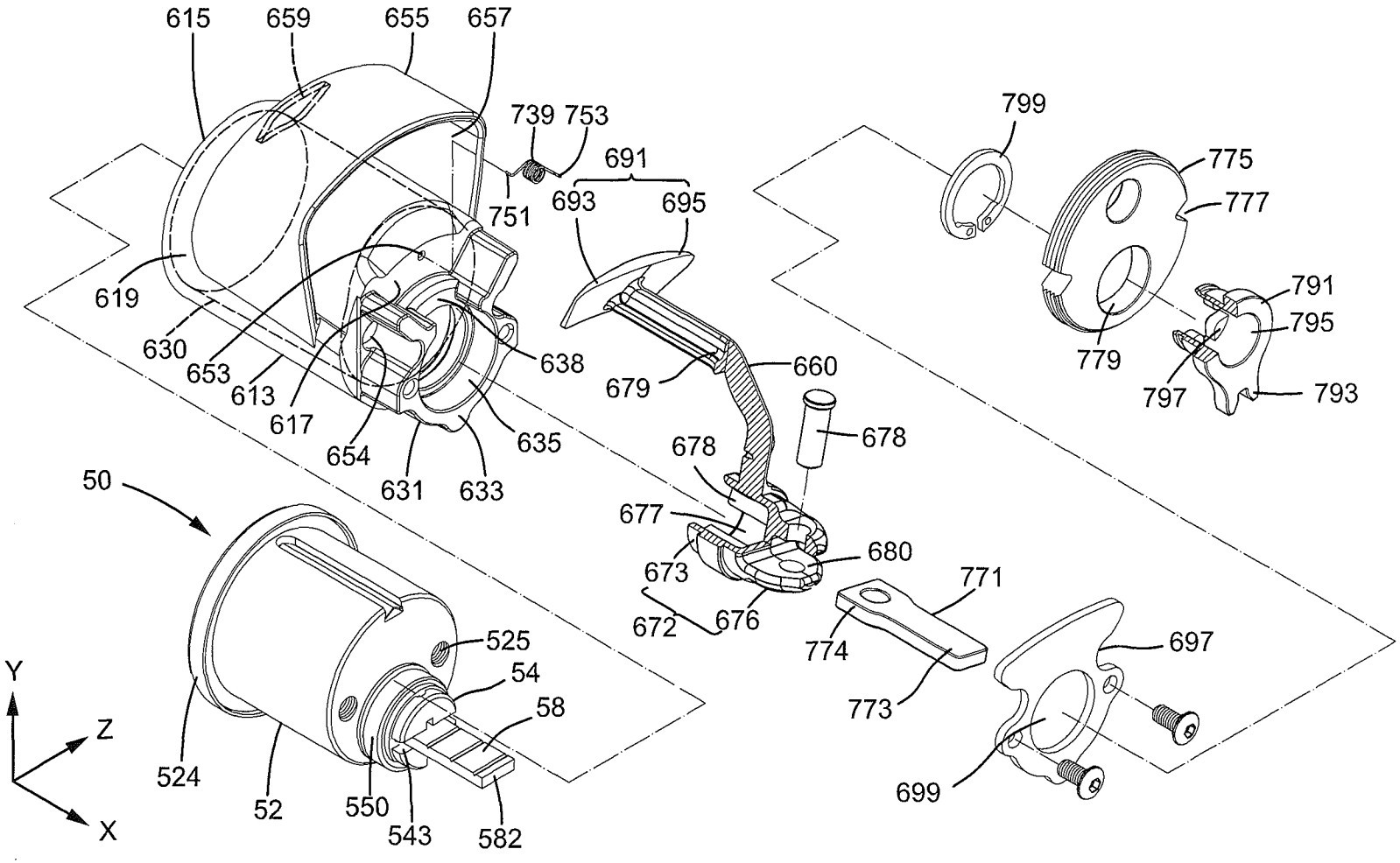
FIG. 9 is an exploded, perspective view of an inner cylinder of the panic exit door lock of FIG. 1.
Figure 10:
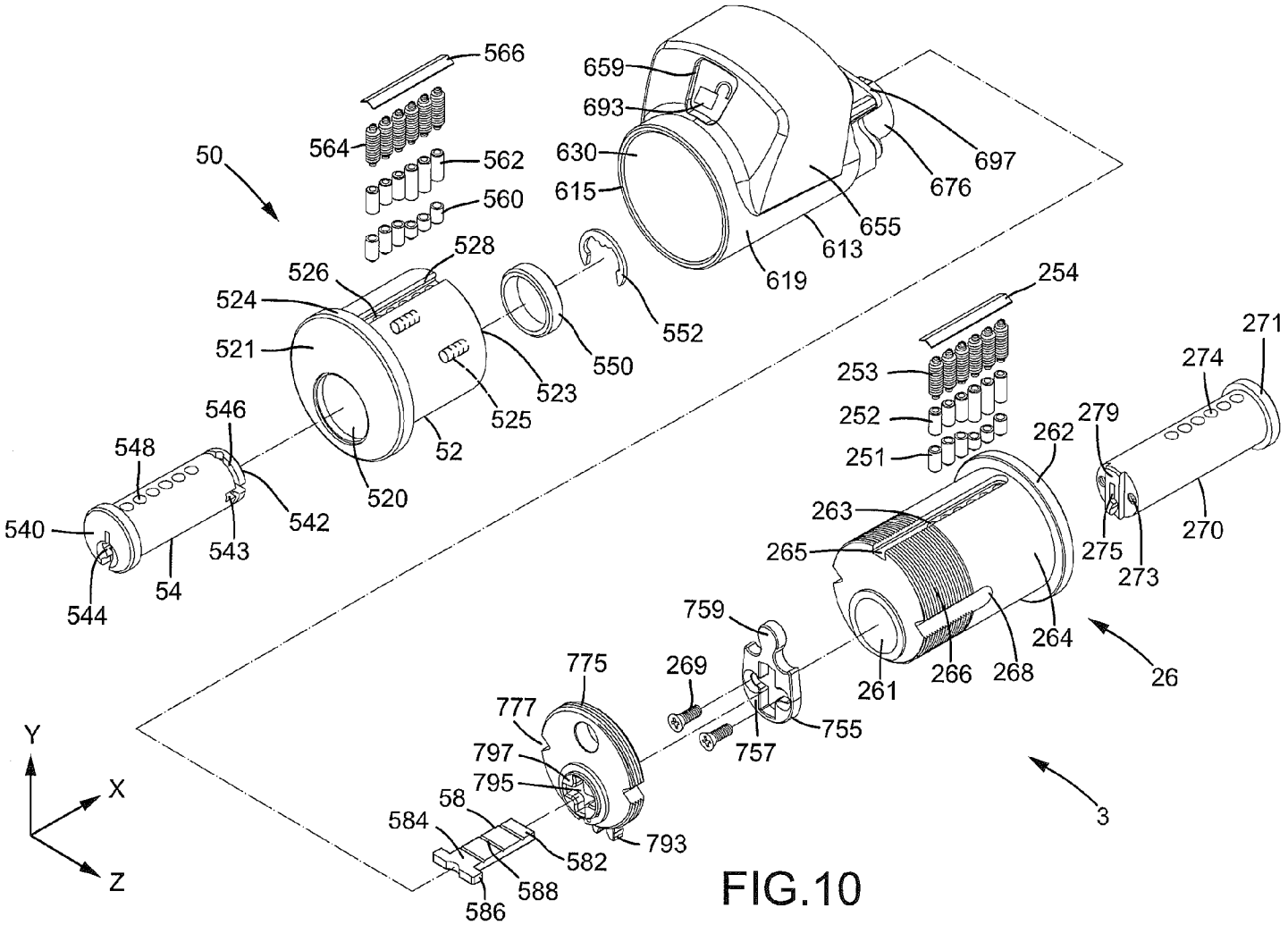
FIG. 10 is an exploded, perspective view of a locking mechanism of the panic exit door lock of FIG. 1.
Figure 14:
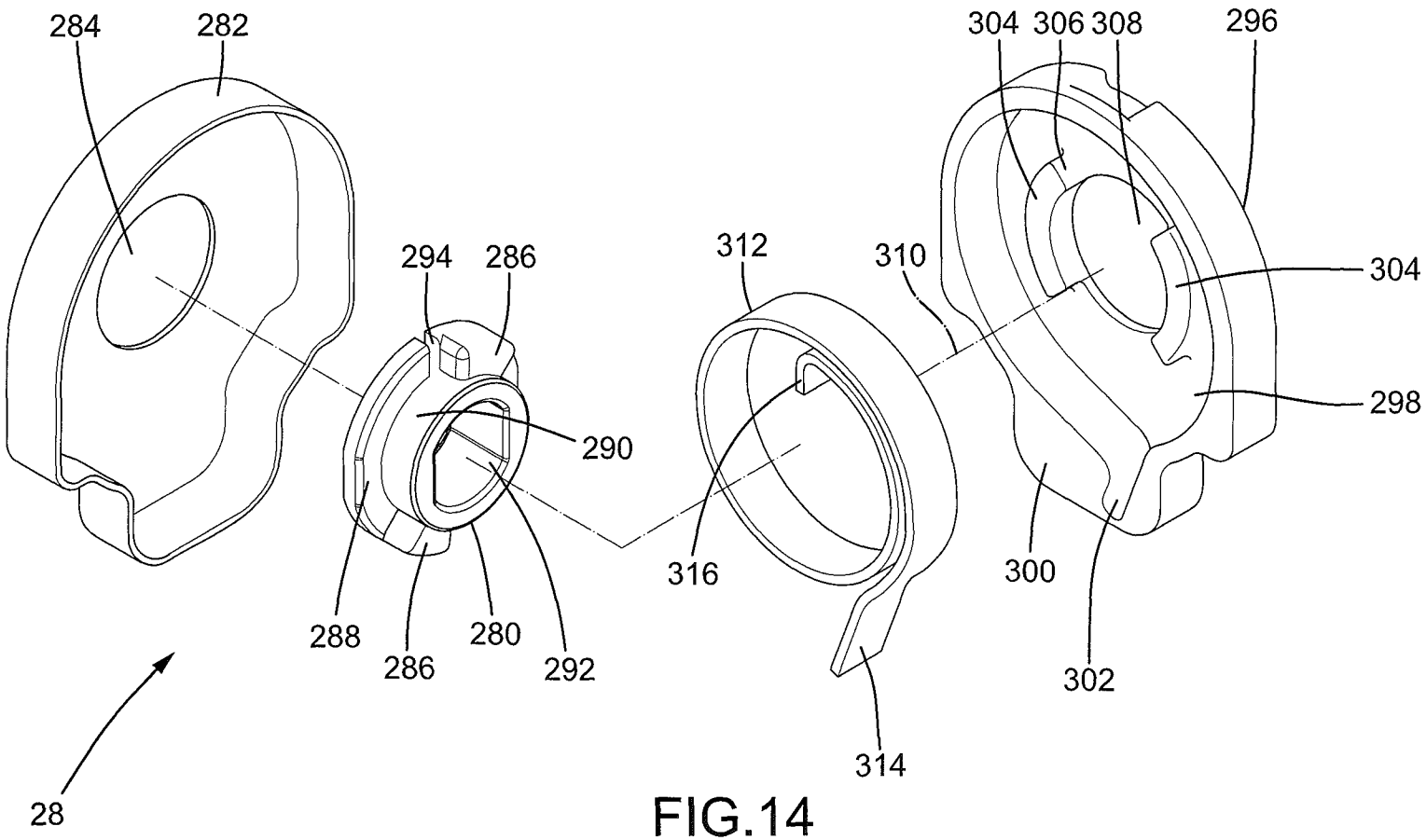
FIG. 14 is an exploded, perspective view of a returning device of the outer operational device.
Figure 19:
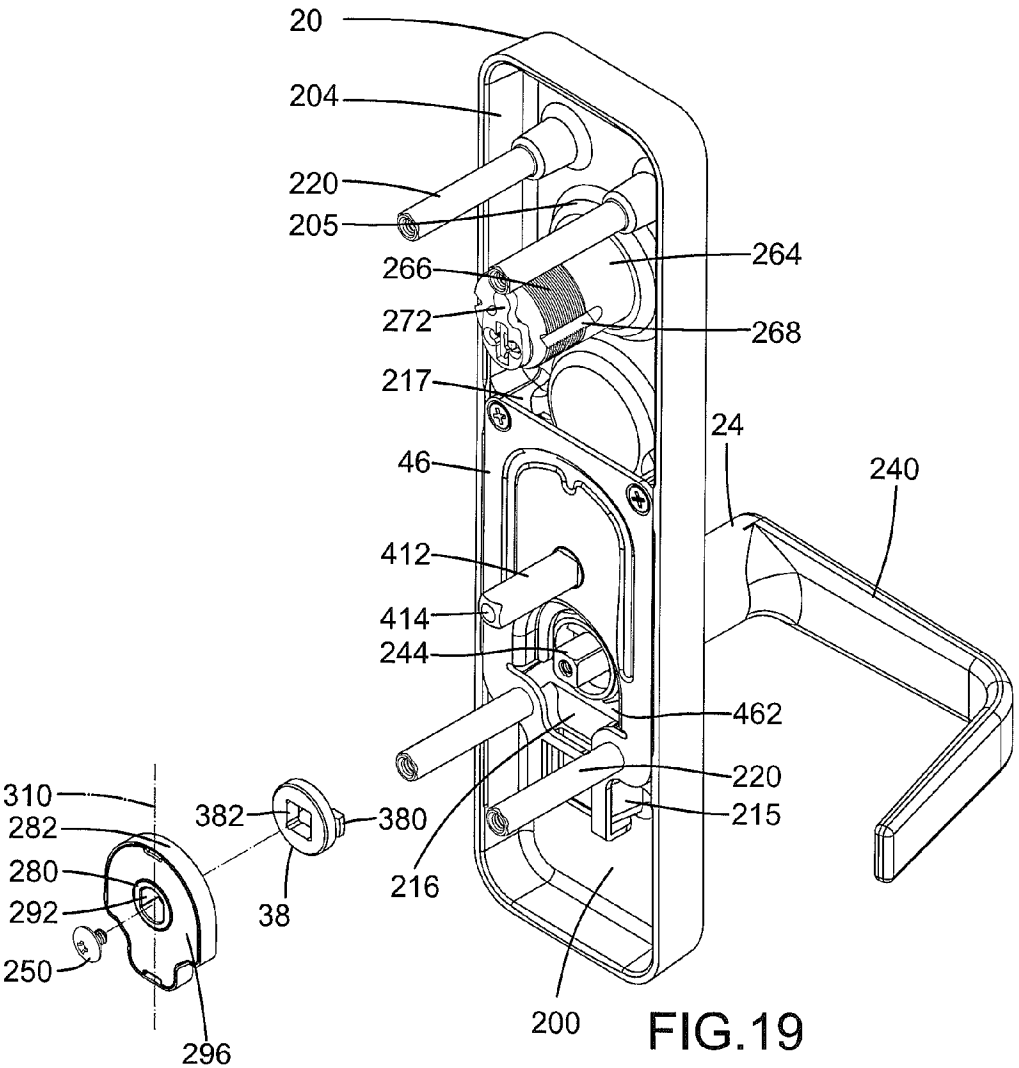
FIG. 19 is a partly exploded perspective view of the panic exit door lock of FIG. 1, with the returning device rotated to a position allowing the panic exit door lock to be mounted to a differently-handed door.
Figure 20:
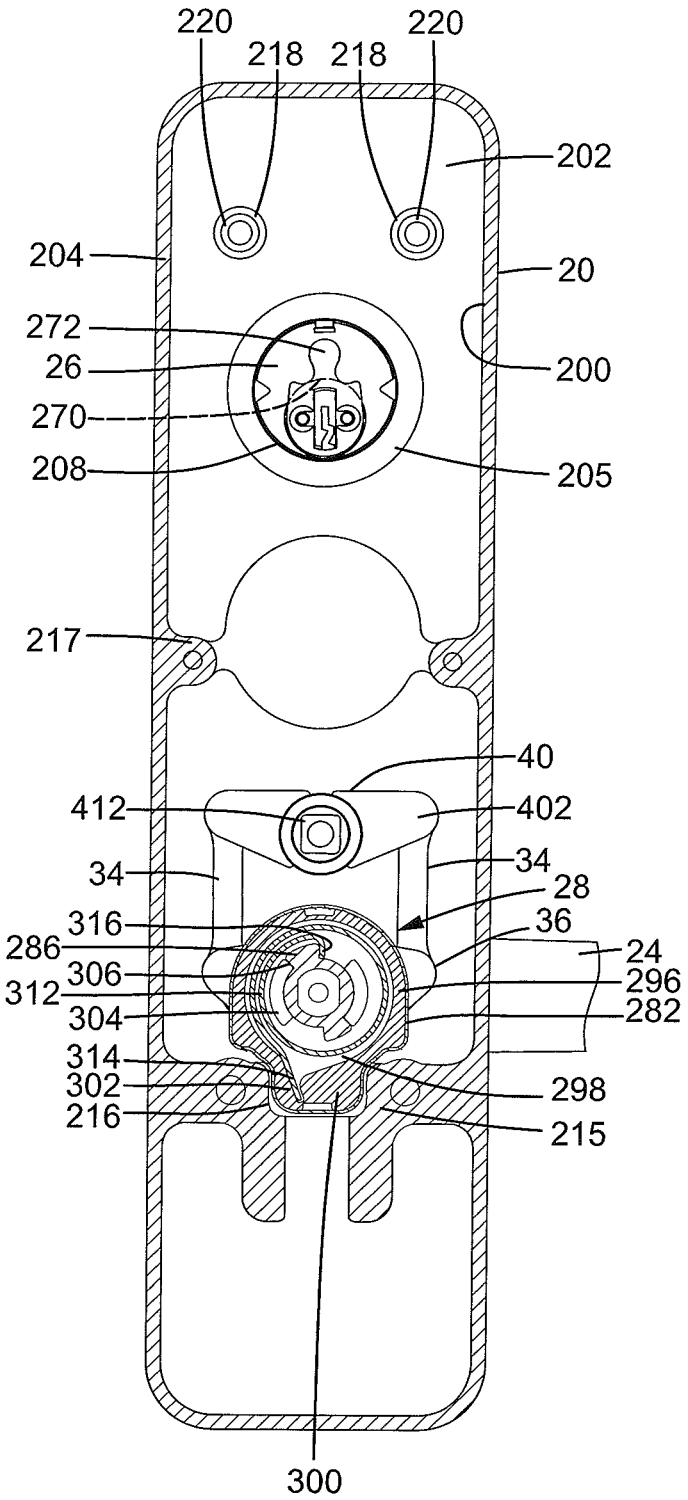
FIG. 20 is cross sectional view of the panic exit door lock of FIG. 19 mounted to a differently handed door.

Furthermore, outer operational device 2 allows easy replacement of handle 24 such that it can be mounted to either a right-handed door or a left-handed door through simple operation. Specifically, door 10 shown in FIGS. 2 and 3 is a right-handed door, and handle 24 is rotated counterclockwise for unlatching purposes. With reference to FIG. 9, when it is desired to mount outer operational device 2 on a left-handed door, fastener 250 is firstly removed. Returning device 28 and follower 38 are then removed from engaging portion 244 of handle 24. Handle 24 is rotated 180° (FIG. 19). Note that other elements are not actuated, because actuating member 36 rotates freely on handle 24. After mounting follower 38 on engaging portion 244 of handle 24, returning device 28 is rotated 180° about an axis 310 (FIG. 14) and then mounted back onto engaging portion 244 of handle 24, with housing 282 located behind body 296 (housing 282 is in front of body 296 when utilized with a right-handed door). Then, fastener 250 is screwed into engaging portion 244 to fix returning device 28 in place. Thus, outer operational device 2 is mounted to a left-handed door. The operational procedure is simple and can be rapidly carried out on the site.

Since follower 38 acts as a medium for driving actuating member 36 when handle 24 is rotated, teeth 380 of follower 38 break when an excessive force is applied to handle 24. Thus, handle 24 rotates freely to avoid damage to outer operational device 2 and other components of outer operational device 2.

Note that when indicator member 660 pivots between two positions while switching locking mechanism 3 between the locking state and the unlocking state, the locking state or unlocking state of locking mechanism 3 can be viewed through window 659 of inner cylinder seat 613. Thus, the user can know whether the locking function of the lock 12 is set by looking through window 659 of locking mechanism 3, overcoming the disadvantages of the prior art.

Now that the basic teachings of the present invention have been explained, many extensions and variations will be obvious to one having ordinary skill in the art. For example, locking mechanism 3 does not have to include actuating plate 771, and second section 676 of indicator member 660 is directly coupled with setting member 791. Alternatively, engagement hole 677 of indicator member 660 can extend through an end face of second section 676 such that tongue 58 can extend through indicator member 660 to engage with setting member 791. All of these provisions allow pivotal movement of indicator member 660 and setting member 791 by rotating inner lock core 54. Furthermore, transmission block 129 and rocker 166 can be integrally formed as a monolithic piece. Specifically, an extension arm can extend from a portion between pivotal portion 129A and second end 129C of transmission block 129 to locking member 160 such that setting member 791 can be driven by rotation of inner lock core 54 to move rocker 166.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A panic exit door lock comprising:

a cover (20) adapted to be mounted to an outer side (10B) of a door (10), with the cover (20) defining a space (200);

a handle (24) rotatably mounted to an outer side of the cover (20);

a driving member (40) mounted in the space (200) of the cover (20), with the driving member (40) operably connected to the handle (24), and with the driving member (40) and the handle (24) pivoting jointly;

a case (122) adapted to be mounted in a mounting hole (105) of the door (10);

an unlocking member (148) pivotably mounted in the case (122), with the unlocking member (148) and the driving member (40) pivoting jointly, and with the unlocking member (148) pivoting when the handle (24) rotates;

a latch (124) slideably received in the case (122) and operably connected to the unlocking member (148), with the latch (124) movable between a latching position outside of the case (122) and an unlatching position inside of case (122) when the unlatching member (148) pivots;

a locking member (160) slideably mounted in the case (122), with the locking member (160) movable between a locking position preventing pivotal movement of the unlocking member (148) and an unlocking position allowing pivotal movement of the unlocking member (148);

a rocker (166) pivotably mounted in the case (122) and operably connected to the locking member (148), with the locking member (160) moving between the locking position and the unlocking position when the rocker (166) pivots;

a base (180) adapted to be mounted to an inner side (10A) of the door (10) opposite to the outer side (10B) of the door (10);

a driving rod (184) pivotably mounted in the base (180), with the driving rod (184) operably connected to the latch (124), and with the latch (124) moving from the locking position to the unlocking position when the driving rod (184) pivots;

an operative member (182) slideably mounted to the base (180) and operably connected to the driving rod (184), with the driving rod (184) pivots when the operative member (182) is moved;

an outer cylinder (26) including an outer cylinder body (264) mounted to the cover (20) and an outer lock core (270) rotatably received in the outer cylinder body (264);

an actuating block (755) fixed to the outer lock core (270), with the actuating block (755) and the outer lock core (270) pivoting jointly, and with the actuating block (755) operably connected to the rocker (166);

an inner cylinder seat (613) fixed to the base (130), with the inner cylinder seat (613) including a peripheral wall (619) defining a first compartment (630), with a shield (655) formed on the peripheral wall (619) and defining a second compartment (657), and with the shield (655) further including a window (659) in communication with the second compartment (657);

an inner cylinder (50) received in the first compartment (630), with the inner cylinder (50) including an inner cylinder body (52) and an inner lock core (54) rotatably received in the inner cylinder body (52);

an indicator member (660) including a pivotal portion (672) pivotably connected to the inner cylinder seat (613), with the indicator member (660) further including an arm (679) extending from the pivotal portion (672), with an indicator (691) provided on the arm (679) and having a first portion (693) indicating the unlocking member (160) is in the unlocking position and a second portion (695) indicating the unlocking member (160) is in the locking position, and with one of the first and second portions (693, 695) selectively aligned with the window (659);

a tongue (58) fixed to the inner lock core (54), with the tongue (58) and the inner lock core (54) pivoting jointly, with the tongue (58) extending through the pivotal portion (672) of the indicator member (660), and with the tongue (58) and the indicator (660) pivoting jointly; and a setting member (791) pivotably mounted in the case (122) and connected to the rocker (166), with the setting member (791) and the rocker (166) moving jointly, with the setting member (791) and the indicator member (660) moving jointly, and with the setting member (791) and the rocker (166) pivoting jointly when the inner lock core (54) pivots, wherein when the inner lock core (54) is rotated in a direction, the indicator member (160) is moved to a position in which the first portion (693) or the second portion (695) is aligned with the window (659) of the inner cylinder seat (613), wherein when the outer lock core (270) is rotated in a direction, the actuating block (755) pivots to drive the setting member (791) to pivot via the rocker (166), causing one of the first and second portions (693, 695) of the indicator member (660) to align with the window (659) of the inner cylinder seat (613), wherein when the first portion (693) of the indicator member (660) is aligned with the window (659) of the inner cylinder seat (613), the locking member (160) is in the locking position, and the unlocking member (148) and the latch (124) are not moved if the handle (24) is rotated, and wherein when the second portion (695) of the indicator member (660) is aligned with the window (659) of the inner cylinder seat (613), the unlocking member (160) is in the unlocking position, and the unlocking member (148) is moved to move the latch (124) from the latching position to the unlatching position if the handle (24) is rotated.

2. The panic exit door lock as claimed in claim 1, with the inner lock cylinder (613) further including a first end face (615) and a second end face (617) spaced from the first end face (615), with the first compartment (630) extending from the first end face (615) through the second end face (617), with the inner cylinder seat (613) further including a pivotal portion (631) extending from the second end face (617), with the pivotal portion (631) including a third end face (633) and a pivotal hole (635) extending from the third end face (633) to the first compartment (630) along the first axis (X), with the pivotal portion (631) further including a notch (638), with the pivotal portion (672) of the indicator member (660) pivotably received in the pivotal hole (635) of the inner cylinder seat (613), and with the arm (679) extending through the notch (638) into the second compartment (657).

3. The outer operational device as claimed in claim 1, with the pivotal portion (672) of the indicative member (660) further including a first section (673) pivotably connected in the pivotal hole (635) of the inner cylinder seat (613), with the pivotal portion (672) of the indicative member (660) further including and a second section (676) having an engagement groove (680), with the setting member (791) including a hole (795), with an inner protrusion (797) formed on an inner periphery of the hole (795) of the setting member (791), with the outer operational device further comprising:

an actuating plate (771) including an engagement end (774) engaged with the engagement groove (680) of the indicator member (660), with the actuating plate (771) further including an actuating end (773) engaged with the hole (795) of the setting member (791), wherein when the inner lock core (54) rotates, the indicator member (660) presses against the inner protrusion (797) via the actuating plate (771) to pivot the setting member (791).

4. The outer operational device as claimed in claim 1, further comprising:

a transmission member (129) pivotably mounted in the case (122), with the transmission member (129) including a pivotal portion (129A) pivotably connected to the rocker (166), with the transmission member (129) further including first and second ends (129B, 129C) and a toothed portion (129D) located between the first and second ends (129B, 129C) of the transmission member (129) and opposite to the pivotal portion (129A) of the transmission member (129), with the first end of the transmission member (129) fixed to the rocker (166), with the rocker (166) and the transmission block (129) pivoting jointly when the setting member (791) pivots, with the setting member (791) further including a transmission section (793) meshed with the toothed portion (129D) of the transmission block (129), wherein when the outer lock core (272) pivots and drives the actuating block (755) to pivot, the actuating block (755) presses the first end (129B) or the second end (129C) of the transmission block (129) to drive the transmission block (129) to pivot, wherein when the actuating block (755) presses against the first end (129B) of the transmission block (129), the locking member (16) moves from the locking position to the unlocking position, and wherein when the actuating block (755) presses against the second end (129C) of the transmission block (129), the locking member (16) moves from the unlocking position to the locking position.

* * * * *